US005244782A

United States Patent [19]

Mifune et al.

[11] Patent Number: 5,244,782

[45] Date of Patent: Sep. 14, 1993

[54] PROCESS FOR PRODUCING SILVER HALIDE PHOTOGRAPHIC EMULSION

[75] Inventors: Hiroyuki Mifune; Shunji Takada, both of Kanagawa, Japan

[73] Assignee: Fuji Photo Film Co. Ltd., Kanagawa, Japan

[21] Appl. No.: 784,673

[22] Filed: Oct. 28, 1991

Related U.S. Application Data

[63] Continuation of Ser. No. 519,354, May 8, 1990, abandoned, which is a continuation of Ser. No. 229,528, Aug. 8, 1988, abandoned.

[30] Foreign Application Priority Data

Aug. 7, 1987 [JP] Japan ..... 62-197741
Sep. 2, 1987 [JP] Japan ..... 62-219983
Sep. 2, 1987 [JP] Japan ..... 62-219984

[51] Int. Cl.[5] ..... G03C 1/015

[52] U.S. Cl. ..... 430/567; 430/569; 430/570; 430/582; 430/583; 430/588; 430/600; 430/603

[58] Field of Search ..... 430/567, 569, 600, 603, 430/570, 582, 583, 588

[56] References Cited

U.S. PATENT DOCUMENTS 4,551,424 11/1985 Ikeda et al. ..... 430/588
4,640,889 2/1987 Komorita et al. ..... 430/505
4,668,614 5/1987 Takada et al. ..... 430/567
4,717,650 1/1988 Ikeda et al. ..... 430/494

FOREIGN PATENT DOCUMENTS 0096727 12/1983 European Pat. Off. .
0097720 1/1984 European Pat. Off. .
0147854 7/1985 European Pat. Off. .
3644223 6/1987 Fed. Rep. of Germany .
61-93447 5/1986 Japan .
2132372 7/1984 United Kingdom .

OTHER PUBLICATIONS

Patent Abstracts of Japan, vol. 11, No. 270 (P-611) (2717) Sep. 3, 1987 & JP-A-62 71947 Apr. 2, 1987.
Patent Abstracts of Japan, vol. 8, No. 153 (P-287 (1590) Jul. 17, 1984 & JP-A-59 50438 (Konishiroku) Mar. 23, 1984.

*Primary Examiner*—Janet C. Baxter
*Attorney, Agent, or Firm*—Sughrue, Mion, Zinn, Macpeak & Seas

[57] ABSTRACT

A silver halide photographic material composed of a support having thereon at least one silver halide emulsion layer containing substantially normal silver halide grains having a (111) plane and a (100) plane and capable of preferentially forming a latent image on the (100) plane; the (111) plane occupying at least about 40% of the surface of the grains or the (100) plane occupying more than about 60% of the surface of the grains; provided that when the (111) plane occupies at least about 40% of the surface of the grains, the grains are spectrally sensitized with (a) at least one spectral sensitizing dye selectively adsorbed more on the (100) plane than on the (111) plane, or (b) at least one spectral sensitizing dye selectively adsorbed more on the (111) plane than on the (100) plane. Since most of a sensitizing dye and the site where a latent image is formed can be separated on the surface of silver halide grains, the photographic material exhibits high sensitivity even when developed with a developing solution having low solubility.

13 Claims, 1 Drawing Sheet

PROCESS FOR PRODUCING SILVER HALIDE PHOTOGRAPHIC EMULSION

This is a continuation of application Ser. No. 07/519,354 filed May 8, 1990, now abandoned which is a continuation of application Ser. No. 07/229,528 filed Aug. 8, 1988, now abandoned.

FIELD OF THE INVENTION

This invention relates to a silver halide photographic material, and more particularly to a silver halide photographic material containing a high sensitivity silver halide emulsion subjected to chemical sensitization and spectral sensitization by a highly controlled method.

BACKGROUND OF THE INVENTION

Silver halide emulsions used in silver halide photographic materials are usually subjected to chemical sensitization using a sulfur sensitizer, a selenium sensitizer, a reduction sensitizer, a noble metal sensitizer, etc., either alone or in combination, for the purpose of obtaining a desired sensitivity and gradation. Among others, sulfur sensitizers, selenium sensitizers and noble metal sensitizers are important.

Further, for the purpose of attaining excellent color reproduction, silver halide emulsions are spectrally sensitized with sensitizing dyes so as to exhibit sensitivity to light of longer wavelengths to which silver halides are by nature substantially insensitive.

With the recent demand for increasing sensitivity of silver halide emulsions, particularly in the wavelength region for which spectral sensitization is performed, it has been attempted to increase the amount of the sensitizing dye to be added to the silver halide emulsion to increase the light absorption.

A spectral sensitization sensitivity Sλ (at a wavelength λ) obtained by addition of a sensitizing dye can be determined according to the equation:

$$S\lambda = \left(\frac{\lambda}{400}\right)\cdot(\phi_r)\cdot\left(\frac{A\lambda}{A400}\right)\cdot\left(\frac{S400}{S^{\circ}400}\right)\cdot S^{\circ}400$$

wherein S°400 and S400 represent the photographic sensitivity of the spectrally non-sensitized emulsion and that of the spectrally sensitized emulsion, respectively, at a wavelength of 400 nm; $\phi_r$ represents a relative quantum efficiency; and Aλ and A400 represent percent absorption at a wavelength of λ and 400 nm, respectively.

Addition of a large quantity of sensitizing dyes is favorable for increasing absorption but, at the same time, causes reduction of $\phi_r$ or reduction of S400/S° 400 (generally called "desensitization of intrinsic sensitivity"), which ultimately results in reduction of photographic sensitivity.

Although various supersensitization techniques have been developed for improving $\phi_r$ or preventing desensitization, the inefficiency resulting from an approach of a saturated adsorption on silver halide grains cannot be sufficiently suppressed by these techniques.

Simson et al. report that inherent desensitization does not occur when a sensitizing dye is adsorbed onto the surface of internal latent image type emulsion grains whose core has been chemically sensitized, as described in J. W. Simson & W. S. Gavgh, *Photographic Science Engineering*, Vol. 19, 339 (1975). However, since the emulsion of this type exhibits internal sensitivity, no image appears when developed with a surface developer. Besides, a color developer used for color photographic materials is not applicable to the internal latent image type emulsion because of its low solubility. All the other conventional developers have insufficient solubility to be applied to the internal latent image type emulsion.

It has also been proposed to use a shallow internal latent image type emulsion which forms a latent image in a very shallow portion beneath the grain surface. However, if silver halide grains have a suitable shell thickness to be developed with a developer having ordinary solubility, desensitization would be likely or development would be considerably retarded.

A chemical sensitization technique is desired which provides a high sensitivity silver halide emulsion without causing reduction of inherent sensitivity due to a dye, as is encountered in using a developer having low solubility.

If chemical sensitization nuclei, i.e., positions where a latent image is to be formed, can be formed on the surface of silver halide grains, unlike the method of Simson et al., apart from most of adsorbed dye particles, the reduction of inherent sensitivity due to the dye should be suppressed even when the silver halide is developed with a general developer of low solubility. The conventional techniques, including the method of Simson et al., rarely have referred to possibility of isolating latent image specks from an adsorbed dye as well as controllability of the position of the chemical sensitization nuclei where a latent image is to be formed. However, intentional formation of chemical sensitization nuclei at a limited position of the surface of silver halide grains without scatter would favor a silver halide emulsion with increased sensitivity. Accordingly, it has been keenly demanded to develop a method for highly controlling the position of chemical sensitization nuclei, and to produce a high sensitivity silver halide emulsion obtained thereby There are some reports with respect to addition of dyes, such as methine dyes, to a silver halide emulsion during chemical sensitization.

Further, several cases have been known where a sensitizing dye is added to a silver halide emulsion at the beginning of chemical sensitization as described, e.g., in U.S. Pat. No. 4,435,501 and Japanese Patent Application No. 62-141112. However, these cases concern silver halide twins (tabular grains). JP-A-61-133941, JP-A-59-9153, JP-A-58-28738 and JP-A-62-7040 also refer to the addition of a sensitizing dye at the time of chemical sensitization. (The term "JP-A" as used herein refers to a "published unexamined Japanese patent application".)

Furthermore, Japanese Patent Application No. 61-311131 describes control of positions of development centers, i.e., positions of chemical sensitization, and particularly formation of development centers, i.e., chemical sensitization nuclei, on a (111) plane. Moreover, the dye is employed without being accurately evaluated for its adsorption selectivity, and halogen conversion is chiefly used here.

Japanese Patent Application No. 62-152330 teaches the use of a compound called a "CR compound" in order to form a development center on the top of octahedral or tetradecahedral normal crystals having a (111) plane, that is, on a plane other than the (111) plane.

In addition, it is also known to add a dye at the time of grain formation preceding chemical sensitization as disclosed, e.g., in U.S. Pat. Nos. 2,735,766, 3,628,960, 4,183,756 and 4,225,666, JP-A-60-196749, JP-A-61-103149 and JP-A-61-165751, and *Research Disclosure,* No. 19227, Vol. 192, 155 (1980). In most of these cases, the dye added exists in the system during the subsequent chemical sensitization.

Some chemical sensitizers which selectively sensitize a (100) plane instead of a (111) plane, and particularly sulfur sensitizers, are known in the art, as described in *Research Disclosure,* Nos. 17643 and 18716, *J. Phys. Chem.,* Vol. 57, 725 (1953), U.S. Pat. Nos. 2,278,947 and 2,410,689, and JP-B-58-28568 (the term "JP-B" as used herein refers to an "examined Japanese patent publication").

Selective chemical sensitization is referred to in *Journal of Photographic Science,* Vol. 23, 249 (1975), describing that sodium thiosulfate chemically sensitizes a (111) plane selectively.

SUMMARY OF THE INVENTION

One object of this invention is to provide a process for preparing a high sensitivity silver halide emulsion, which includes chemical sensitization and spectral sensitization under control.

Another object of this invention is to provide a silver halide light-sensitive material containing the above-described high sensitivity silver halide emulsion.

It has now been found that these and other objects of the invention can be accomplished by a silver halide photographic material comprising a support having thereon at least one silver halide emulsion layer containing substantially normal silver halide grains having a (111) plane and a (100) plane and capable of preferentially forming a latent image on the (100) plane; the (111) plane occupying at least about 40% of the surface of the grains or the (100) plane occupying more than about 60% of the surface of the grains; provided that when the (111) plane occupies at least about 40% of the surface of the grains, the grains are spectrally sensitized with (a) at least one spectral sensitizing dye selectively adsorbed more on the (100) plane than on the (111) plane, or (b) at least one spectral sensitizing dye selectively adsorbed more on the (111) plane than on the (100) plane.

DETAILED DESCRIPTION OF THE INVENTION

Figure 1:
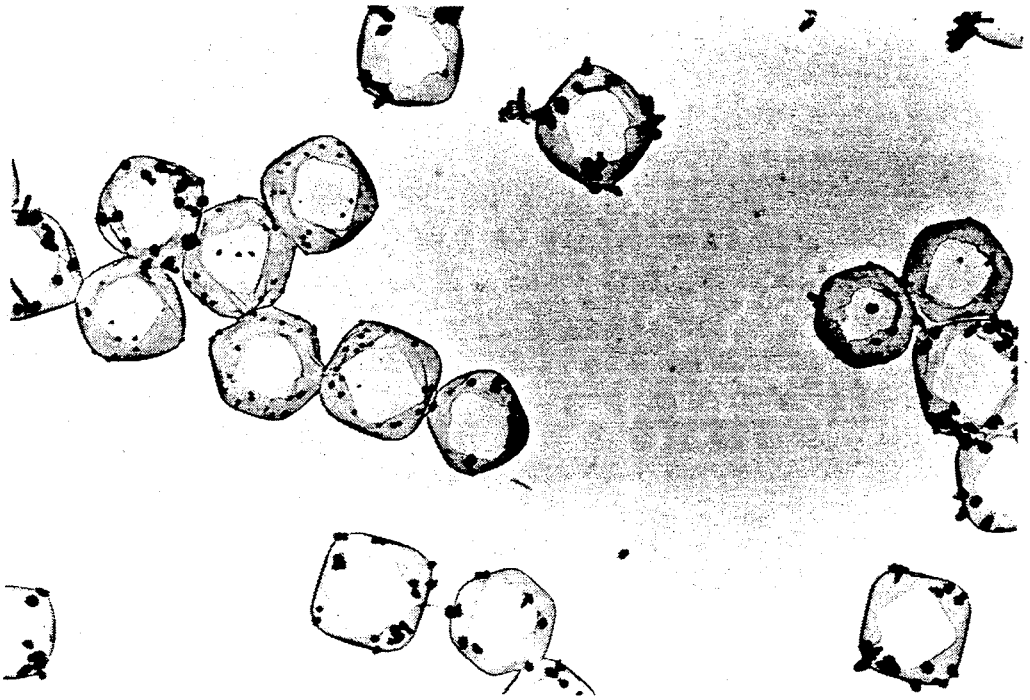
FIGS. 1 and 2 are electron micrographs (magnification: ×15,600) of silver halide crystal grains in Samples 1 and 2 prepared in Example 1, respectively.

The normal silver halide grains contained in the silver halide emulsion layer of the present invention are crystals having substantially no stacking fault of twin plane. The silver halide grains of the present invention have both (111) plane and (100) plane on which a latent image is preferentially formed, and the grains may have a high index of (h, k, l) plane such as (311) plane, (210) plane, (321) plane and (211) plane. The normal silver halide grains generally have an average grain size of from 0.1 to 6 μm, preferably from 0.1 to 4 μm, more preferably from 0.2 to 3 μm, and the grains are generally contained in an amount of at least 50%, preferably 60% or more, particularly preferably 75% or more, based on the total projected area of silver halide grains contained in the silver halide emulsion layer.

When the (111) plane occupies at least 40% of the surface of the silver halide grains having a (111) plane and a (100) plane, the grains are spectrally sensitized with a spectral sensitizing dye selectively adsorbed more on one plane than on the other plane, generally the amount of the dye adsorbed on the one surface being least 60%, preferably 70% or more and particularly preferably 75% or more, based on the total amount of the dye adsorbed on both planes.

Typical embodiments of the light-sensitive materials according to the present invention include: (I) A silver halide photographic material comprising a support having thereon at least one silver halide emulsion layer containing at least 50%, based on the total projected area of silver halide grains, of substantially normal silver halide grains mainly composed of a (111) plane and a (100) plane, wherein the (111) plane occupies at least about 40% of the surface of the normal grains, at least about 60% of the number of the normal grains being spectrally sensitized with at least one sensitizing dye selectively adsorbed more on the (111) plane than on the (100) plane, and being capable of preferentially forming a latent image on the (100) plane. (II) A silver halide photographic material comprising a support having thereon at least one silver halide emulsion layer containing substantially normal silver halide grains having a (111) plane and a (100) plane, wherein the (111) plane occupies at least about 40% of the surface of the grains, the normal grains being spectrally sensitized with at least one sensitizing dye selectively adsorbed more on the (100) plane than on the (111) plane and being capable of preferentially forming a latent image on the (100) plane. (III) A silver halide photographic material comprising a support having provided thereon at least one silver halide emulsion layer containing substantially normal silver halide grains having a (111) plane and a (100) plane, wherein the (100) plane occupies at least about 60% of the surface of the grains, the grains being capable of preferentially forming a latent image on the (100) plane.

The embodiment (I) according to the present invention will be described in greater detail below.

In the present invention, chemical sensitization nuclei, i.e., positions where a latent image is formed, are formed apart from most of an adsorbed dye under rigid control. The inventors have found that this can be accomplished by the following two methods. (A) A dye which tends to be adsorbed more on a (111) plane than on a (100) plane of silver halide grains is chosen in accordance with the method hereinafter described, and silver halide grains are chemically sensitized in the presence of such a dye, preferably in an amount enough to completely cover the (111) planes. As a result, a latent image can be formed on planes other than the (111) planes, i.e., planes on which the dye has not been adsorbed. (B) A chemical sensitizer (particularly a sulfur sensitizer) which is capable of selectively chemically sensitizing a (100) plane more than a (111) plane of the silver halide grains so that a latent image can be formed thereon is chosen in accordance with the method hereinafter described, and silver halide grains are chemically sensitized with such a chemical sensitizer. In this case, the addition of the dye which is selectively adsorbed on the (111) plane as described in the method (A) may be effected either before or after the chemical sensitization.

Method (B) requires a chemical sensitizer capable of selectively sensitizing the (100) plane, while method (A) permits the use of any kind of chemical sensitizers as described in *Research Disclosure,* Nos. 17643 and 13716. It is preferable to use a chemical sensitizer selectively sensitizing the (100) plane.

In both methods (A) and (B), as long as the position where a latent image is to be formed is controlled, a dye which is easily adsorbed on planes other than the (111) plane or a dye which is evenly adsorbed on all planes may be added, if desired, in combination with the above-described dye for selective adsorption onto the (111) plane before or after or during the chemical sensitization.

In the present invention, a sensitizing dye to be used should be evaluated for its selective adsorption on a particular plane of silver halide grains, and also the indices of planes of silver halide grains should be considered. Based on these results and taking advantage thereof, chemical sensitization nuclei (i.e., positions where a latent image is to be formed) are formed at a limited position under control to thereby obtain an excellent light-sensitive silver halide emulsion having been spectrally sensitized.

In the present invention, chemical sensitization is effected selectively on a (100) plane while a (111) plane is covered more positively with a sensitizing dye whose adsorption selectivity has been judged, thus providing a highly refined technique.

While method (B) requires a compound which chemically sensitizes a (100) plane selectively, method (A) permits the use of any kind of chemical sensitizers to preferentially form a latent image at positions other than a (111) plane.

To accomplish this result, a chemical sensitizer is added after a (111) plane occupying 40% or more of the silver halide grain surface is covered with a sensitizing dye which is adsorbed selectively on the (111) plane among other planes. Therefore, formation of effective chemical sensitization nuclei on the (111) plane is inhibited, while effective chemical sensitization nuclei are formed preferentially on uncovered or less covered planes other than the (111) plane, for example, a (100) plane. As a result, a latent image can be formed in a limited position.

The position where a latent image is to be formed can be limited more strictly by using the dye in an amount greater than that required for covering the (111) plane or by using a small amount of a dye which is adsorbed selectively on other planes in combination.

Thus, since the position where most of the dye is adsorbed and the position where a latent image is to be formed can be separated on the surface of silver halide grains, a large quantity of a dye can be used and a number of common developers having small solubility can be employed without being accompanied by development delay as encountered in the case of shallow internal latent image type grains to thereby obtain a high sensitivity silver halide emulsion.

In the silver halide emulsion containing substantially normal grains which can be used in the present invention, at least about 40%, preferably at least about 60%, more preferably at least about 80% of the grain surface is occupied by a (111) plane, with the surface area occupied by a (100) plane preferably ranging from about 5 to about 20%.

In general, the surface of silver halide grains is composed of a (100) plane, a (111) plane, and a (110) plane and, in most cases, composed of a (100) plane and a (111) plane. The plane ratio can be obtained by directly observing an electron micrograph taken of a carbon replica of silver halide grains. For more precise determination, the method described in *Nippon Kagaku Kaishi,* No. 6, 942 (1984) can be adopted, which utilizes the fact that anhydro-3,3'-bis(sulfobutyl)-9-methylthiacarbocyanine hydroxide pyridinium salt gives a reflective spectrum markedly differing depending on the plane on which it is adsorbed. That is, the reflective spectra of a thick emulsion layer containing the above-described dye in varied amounts are obtained and evaluated using Kubelka-Munk's formula to obtain the ratios of the (100) plane and the (111) plane.

The position where a latent image is formed can be discriminated as follows.

A light-sensitive material composed of a support coated with a silver halide emulsion is exposed to light at an exposure of from (a) an exposure corresponding to (maximum density − minimum density) × ½ of a characteristic curve of a silver image obtained when exposed for 1 second and developed with a developer "MAA-1" (produced by Eastman Kodak Co., Ltd.) at 20° C. for 10 minutes to (b) an exposure 1,000 times that exposure. The exposed material is then developed with an arresting developing solution having the following formulation at 20° C. for 10 minutes. The development time, the pH of the developing solution, and the amount of a surface active agent used should be varied depending on the grain size or halogen composition of the silver halide grains so that fine silver spots indicating development centers may be observed easily.

| Arresting Developing Solution Formulation: | |
|---|---|
| Methol | 0.45 g |
| Ascorbic Acid | 3.0 g |
| Borax | 5.0 g |
| KBr | 1.0 g |
| Surface Active Agent (cetyl trimethylammonium chloride) | 0.2 g |
| Water to make | 1 liter |

In cases where development arresting is too strong due to a high iodine content of the silver halide grains or by the action of a sensitizing dye used, the pH of the developing solution can be slightly elevated with a sodium hydroxide aqueous solution or the development time is extended.

The surface active agent in the arresting developer serves to set the developed silver which is apt to extend in the form of filaments into masses so as to facilitate judgment of the position of the developed silver.

The development is stopped with a 5 wt % aqueous solution of glacial acetic acid and, without effecting fixation, subjected to enzymatic decomposition using pronase to recover silver halide grains. Thereafter, a small amount of the material is placed on a micromesh of an electron microscope. After carbon is vacuum evaporated thereon to prevent formation of print-out silver, the developed material is fixed with a fixing solution, and a carbon replica thereof is prepared. The position of remaining developed silver, i.e., the position where a latent image is formed, is observed under an electron microscope.

The phrase "capable of preferentially forming a latent image on the (100) plane" as used herein means that a major proportion, e.g., 60% or more, preferably 70% or more, particularly preferably 75% or more, of the fine silver specks formed by the above-described arrested development is formed on the (100) plane. It is the best that all of the fine silver specks are formed on the (100) plane. A few fine silver specks may, however, be formed on the (111) plane in a proportion of less than 40% and preferably less then 30%.

The compound capable of chemically sensitizing the (100) plane selectively which can be used in method (B) can be selected as follows.

As emulsion comprising tetradecahedral pure silver bromide grains having (111) and (100) planes in an equal proportion is prepared. The emulsion is chemically sensitized with a compound under examination to the degree optimum for 1 second exposure and then subjected to the above-described determination of the latent image position. An illustrative example for the selection of the chemical sensitizer will be given in Example 1.

The compound capable of chemically sensitizing the (100) plane selectively mainly includes sulfur sensitizers. Such sulfur sensitizers include organic chemical sensitizers, such as thioureas, rhodanines, and polysulfides and polysulfides. Selanoureas may also be used as a chemical sensitizer. Noble metal sensitizers, such as gold, platinum, palladium and iridium, can also be used. In addition, unstable sulfur compounds such as conventional thiosulfates can be used, and particularly preferably in the presence of the abovedescribed dye which is adsorbed more on the (111) plane than on the (100) plane.

Specific examples of preferred chemical sensitizers are shown below, but the present invention is not to be construed as being limited thereto.

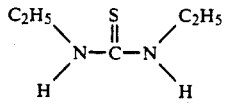
S-1

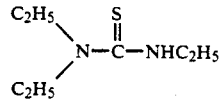
S-2

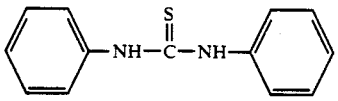
S-3

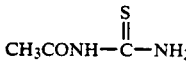
S-4

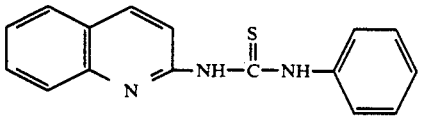
S-5

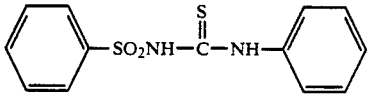
S-6

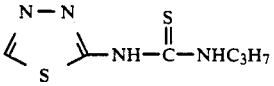
S-7

-continued

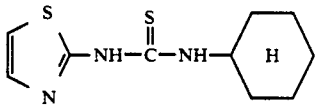
S-8

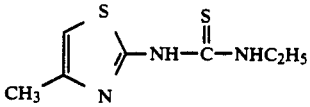
S-9

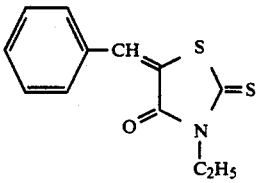
S-10

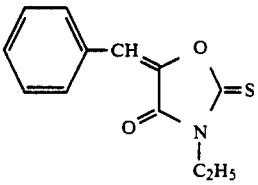
S-11

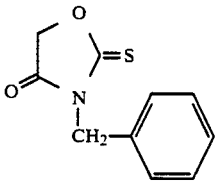
S-12

The sensitizing dye which is selectively adsorbed onto a (111) plane instead of a (100) plane of silver halide grains can be determined by the following three methods.

(1) Determination by Absorption Spectrum.

Octahedral silver bromide grains composed of (111) planes and cubic silver bromide grains composed of (100) planes are prepared (silver bromide may be replaced by silver iodobromide or silver chlorobromide). The surface area of each of these grains is obtained from the respective electron micrograph, and both grains are mixed together to prepare a silver halide emulsion at such a mixing ratio that the area of the (111) plane and that of the (100) plane are equal.

Of methine dyes that are photographically useful and also preferred in the present invention, those giving different absorption spectra depending on whether they are adsorbed on a (111) plane or a (100) plane can be evaluated for their selectivity in adsorption between these two planes from their absorption spectra. That is, the absorption spectrum of a dye adsorbed on each of the cubic grains and the octahedral grains is obtained in advance, and the absorption spectrum of the dye when added to the above-prepared mixed emulsion is then determined, whereby the plane on which the dye begins to be selectively adsorbed can be judged from the absorption peak wavelength.

Further, the plane on which the dye begins to be adsorbed can be quantitatively determined from the resulting spectrum according to the method described in the above-cited *Nippon Kagaku Kaishi*, No. 6, 942 (1984).

(2) Determination by Emulsion Separation

Octahedral silver bromide grains and cubic silver bromide grains greatly differing in grain size are mixed so as to have the (111) and (100) planes at an equal area ratio.

A dye is added to the resulting mixed emulsion and adsorbed thereon. The emulsion is then separated into the octahedral grains and the cubic grains, and the amount of the dye in each separated emulsion is quantitatively determined.

An example illustrating this method is given in Example 2.

(3) Determination by Photographic Technique

Octahedral silver bromide grains and cubic silver bromide grains are mixed so as to have the (111) planes and (100) planes in equal proportions. The silver bromide may be replaced by silver iodobromide or silver chlorobromide. The sensitivity of the octahedral grains should be remarkably lower than that of the cubic grains, so that only the cubic grains will contribute to the photographic sensitivity of the mixed emulsion. In more detail, the octahedral grains are doped with rhodium. Even if a dye is adsorbed on such rhodium-doped octahedral grains to any high degree, spectral sensitization due to the dye does not occur. It is not until the dye is adsorbed onto the cubic grains that spectral sensitivity due to the dye is imparted to the mixed emulsion.

As is seen from the foregoing, when a dye which is selectively adsorbed more on a (111) plane than on a (100) plane is added to the mixed emulsion, since it begins to be adsorbed first on the octahedral grains, spectral sensitivity cannot be obtained until the octahedral grains are saturated with the adsorbed dye.

The cubic grains begin to adsorb the dye to acquire spectral sensitivity after the saturation of the octahedral grains is reached.

Then, an emulsion solely composed of cubic grains having the same surface area as that of the above-prepared mixed emulsion, in which the half of the grains have been doped with rhodium so as to have an extremely low sensitivity, is prepared, and the relationship between the amount of a dye added thereto and the spectral sensitivity obtained is established in advance. A given amount of the added dye being taken as b, the amount of the dye added to the mixed emulsion which affords the same sensitivity as that obtained with b is taken as a. When the dye of the amount a is added to the mixed emulsion, the amount of the dye on the cubic grains and that on the octahedral grains can be quantitatively obtained as (b/2) and (a−b/2), respectively.

The inventors have chosen dyes which are adsorbed more easily on a (111) plane than on a (100) plane in accordance with the above-described three methods of determination.

Such dyes are preferably chosen from among methine dyes. Specific examples of methine dyes include cyanine dyes, merocyanine dyes, complex cyanine dyes, complex merocyanine dyes, holopolar cyanine dyes, hemicyanine dyes, styryl dyes, and hemioxonol dyes, with cyanine dyes, merocyanine dyes and complex merocyanine dyes being particularly useful.

Any nuclei commonly utilized in cyanine dyes as basic heterocyclic nuclei can be present in these dyes. Such nuclei include a pyrroline nucleus. an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus; the above-enumerated nuclei to which an alicyclic hydrocarbon ring has been fused; and the above-enumerated nuclei to which an aromatic hydrocarbon ring has been fused, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus. These nuclei may have a substituent on their ring.

Merocyanine dyes or complex merocyanine dyes can contain 5- to 6-membered heterocyclic nuclei having a ketomethylene structure, e.g., a pyrazoline-5-one nucleus, a thiohydantoin nucleus, a 2-thiooxazolidine-2,4-dione nucleus, a thiazolidine-2,4-dione nucleus, a rhodanine nucleus or a thiobarbituric acid nucleus.

The dye to be used in the present invention can be chosen from conventional compounds, such as those recited in *Research Disclosure*, No. 17643, 23, IV (December, 1978) or those described in the publications cited therein. Typical examples of these methine dyes which can be used preferably are cyanine dyes, and more particularly thiocyanine dyes, selenacyanine dyes, quinocyanine dyes, thiaquinocyanine dyes, selenaquinocyanine dyes.

More preferred cyanine dyes include benzothiacyanines, benzoselenacyanines and benzothiaselenacyanines each having a halogen substituent (e.g., a chlorine atom) at the 5-position thereof; thiaquinocyanines or selenaquinocyanines having, on one side thereof, a thiazole or selenazole ring substituted with a halogen atom at the 5-position thereof; and quinocyanines.

Particularly preferred among them are those forming J-aggregates on silver halide grains.

The amount of these sensitizing dyes is preferably at least an amount enough to saturate the (111) plane and not more than an amount that saturates all of the (111) and (100) planes.

Preferred examples of the dye which is selectively adsorbed on the (111) plane of silver halide grains are shown below, but the present invention is not to be construed as being limited thereto.

D-1

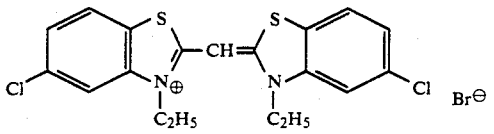

D-2

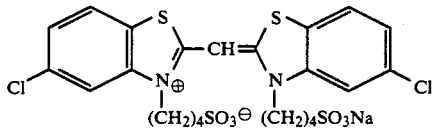

D-3

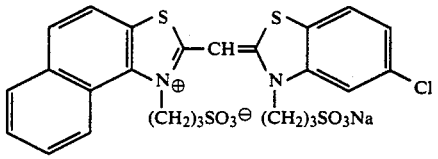

D-4

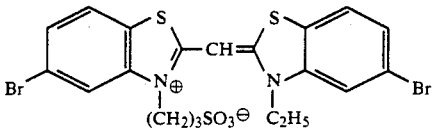

-continued
D-5
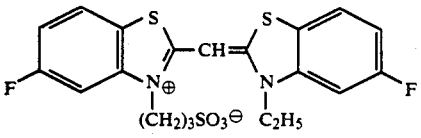
D-6
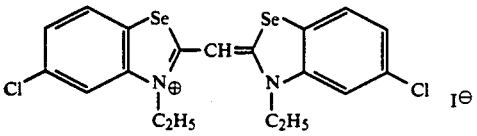
D-7
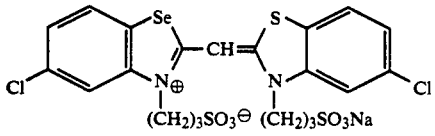
D-8
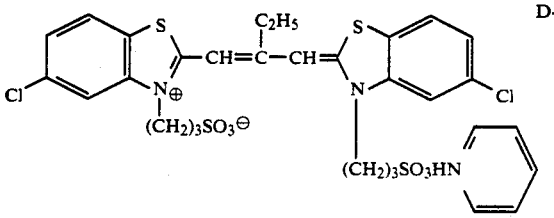
D-9
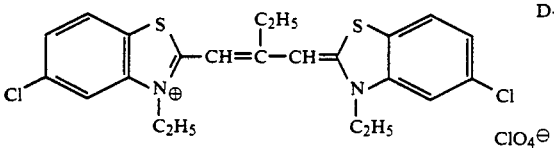
D-10
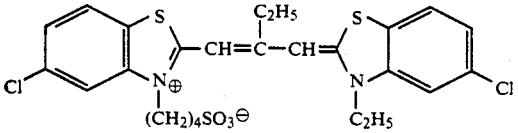
D-11
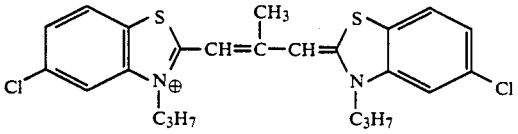
D-12
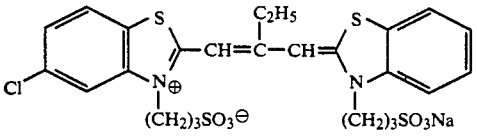
D-13
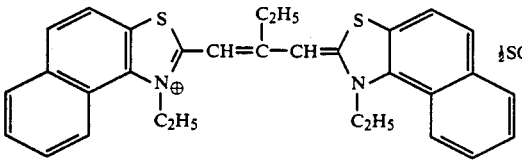
D-14
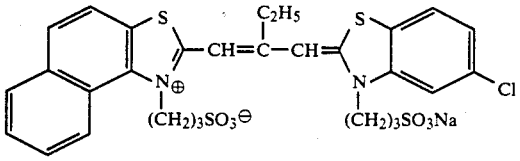
-continued
D-15
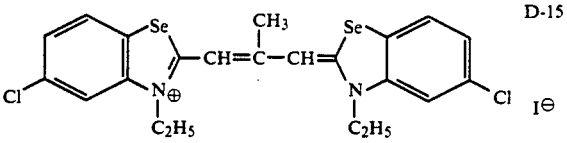
D-16
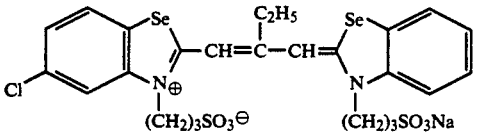
D-17
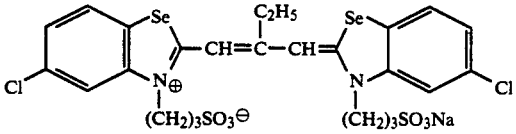
D-18
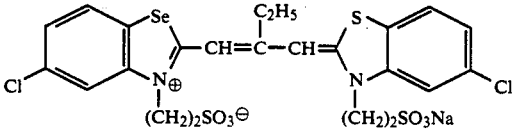
D-19
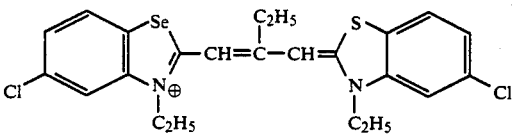
D-20
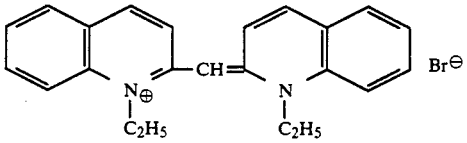
D-21
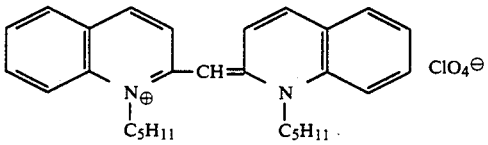
D-22
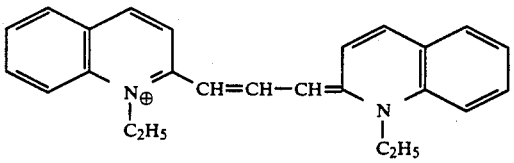
D-23
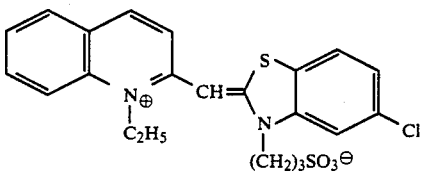
D-24
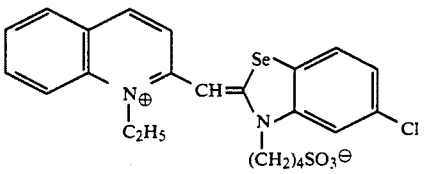

-continued

D-25

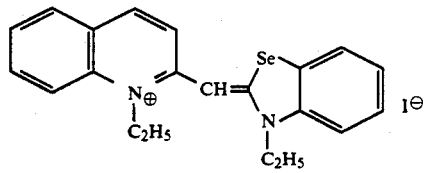

D-26

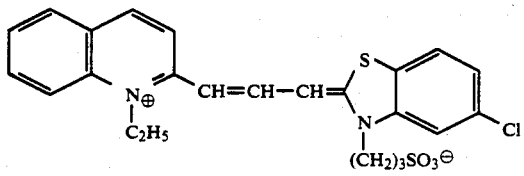

The silver halide which can be used in the present invention may be any of silver bromide, silver iodobromide, silver iodochlorobromide, silver chlorobromide, silver iodide, and silver chloride, with silver bromide, silver iodobromide, silver iodochlorobromide, and silver chlorobromide being particularly preferred. The silver chloride content is preferably 50 mol % or less.

Conditions for chemical sensitization according to the present invention are not particularly limited. The pAg preferably ranges from 6 to 11, more preferably 7 to 10, most preferably 7 to 9.5, and the temperature from 40° to 95° C., more preferably 50° to 85° C.

The amount of the chemical sensitizers such as a sulfur sensitizer and a gold sensitizer ranges from $10^{-8}$ to $10^{-3}$ mol, preferably from $10^{-7}$ to $10^{-4}$ mol, per mol of silver halide.

As a gold sensitizer, any known compound, such as a chloroaurate and a potassium aurothiocyanate, may be employed.

The individual silver halide grains may be homogeneous throughout the crystal structure or may have a layered structure composed of an outer shell and a core having different halogen compositions. Further, the grains may be fused type crystals composed of an oxide crystal (e.g., PbO) and a silver halide crystal (e.g., silver chloride) or epitaxially grown crystals, e.g., silver bromide grains on which silver chloride, silver iodobromide, silver iodide, etc., is epitaxially grown.

The silver halide grains in photographic emulsions may have any size distribution or may be monodisperse. The term "monodispersion" as used herein means a dispersion system in which 90% of the grains fall within a size range of 60%, preferably 40%, of the number average particle size. The term "number average particle size" as used herein means the number average diameter of the projected area of silver halide grains.

The photographic emulsion of the present invention can be prepared by known techniques as described, e.g., in P. Glafkides, *Chemie et Physique Photographique* (Paul Montel, 1967), G. F. Duffin, *Photographic Emulsion Chemistry* (The Focal Press, 1966), and V. L. Zelikman et al., *Making and Coating Photographic Emulsion* (The Focal Press, 1964). In some detail, the emulsion can be prepared by any of an acid process, a neutral process, an ammonia process, and the like. The reaction between a soluble silver salt and a soluble halogen salt can be carried out by any of a single jet method, a double jet method, a combination thereof, and the like.

A reverse mixing method may also be adopted, in which grains are formed in the presence of excess silver ions. Further, a controlled double jet method, in which a pAg of a liquid phase where silver halide grains are formed is maintained constant, may also be used. According to the controlled double jet method, an emulsion of grains having a regular crystal form and a nearly uniform grain size can be obtained.

Two or more silver halide emulsions separately prepared may be used as a mixture.

During the formation of silver halide grains or subsequent physical ripening, a cadmium salt, a zinc salt, a lead salt, a thallium salt, an iridium salt or a complex salt thereof, a rhodium salt or a complex salt thereof, an iron salt or a complex salt thereof may be present in the system. Among them, addition of an iridium salt, a rhodium salt or an iron salt is preferred. The amount of these compounds may be either small or large depending on the end use.

If desired, known silver halide solvents may be used. Examples of the silver halide solvents include ammonia, potassium thiocyanate, and thioethers or thione compounds described in U.S. Pat. No. 3,271,157 and JP-A-51-12360, JP-A-53-82408, JP-A-53-144319, JP-A-54-100717 and JP-A-54-155828.

For the purpose of preventing fog during preparation, preservation or photographic processing of the photographic materials or stabilizing photographic performance properties, the photographic emulsion can contain various compounds. Such compounds include azoles, such as benzothiazolium salts, nitroindazoles, triazoles, benzotriazoles, and benzimidazoles (particularly nitro- or halogen-substituted azoles); heterocyclic mercapto compounds, e.g., mercaptothiazoles, mercaptobenzothiazoles, mercaptobenzimidazoles, mercaptothiadiazoles, mercaptotetrazoles (especially 1-phenyl-5-mercaptotetrazole), and mercapropyrimidines; the above-enumerated heterocyclic mercapto compounds having a water-soluble group, e.g., a carboxyl group, a sulfo group; thioketo compounds, e.g., oxazolinethione; azaindenes, e.g., tetraazaindenes (particularly 4-hydroxy-substituted (1,3,3a,7)tetraazaindenes); benzenethiosulfonic acid, benzenesulfinic acid; and many other compounds known as antifoggants or stabilizers. Details are disclosed in E. J. Birr, *Stabilization of Photographic Silver Halide Emulsion* (The Focal Press, 1974).

If desired, sensitizing dyes other than the above-described spectrally sensitizing dyes in accordance with the present invention may be added to the photographic emulsion immediately before coating. Such sensitizing dyes include cyanine dyes, merocyanine dyes, complex cyanine dyes, complex merocyanine dyes, holopolar cyanine dyes, hemicyanine dyes, styryl dyes, oxonol dyes and hemioxonol dyes. Specific examples of these sensitizing dyes are described, e.g., in P. Glafkides, *Chimie Photographique*, Chapters 35 to 41 (Paul Montel, 2nd Ed., 1957), F. M. Hamer, *The Cyanine and Related Compounds* (Interscience), U.S. Pat. Nos. 2,503,776, 3,459,553 and 3,177,210, and *Research Disclosure*, Vol. 176, 17643, 23-IV (December, 1978).

The hydrophilic colloidal layers of the photographic material according to the present invention may contain various water-soluble dyes as filter dyes or for prevention of irradiation or for other purposes. Such water-soluble dyes include oxonol dyes, hemioxonol dyes, styryl dyes, merocyanine dyes, cyanine dyes and azo dyes, with oxonol dyes, hemioxonol dyes and merocyanine dyes being particularly useful.

The photographic emulsion layers or other hydrophilic colloidal layers can further contain organic or inorganic hardening agents. Examples of the hardening agents include chromates (e.g., chromium alum, chromium acetate), aldehydes (e.g., formaldehyde, glyoxal, glutaraldehyde), N-methylol compounds (e.g., dimethylolurea, methyloldimethylhydantoin), dioxane derivatives (e.g., 2,3-dihydroxydioxane), active vinyl compounds (e.g., 1,3,5-triacryloylhexahydro-s-triazine, 1,3-vinylsulfonyl-2-propanol), active halogen compounds (e.g., 2,4-dichloro-6-hydroxy-s-triazine), mucohalogenic acids (e.g., mucochloric acid, mucophenoxychloric acid), either individually or in combination thereof.

The photographic emulsion layers or other hydrophilic colloidal layers of the photographic materials may furthermore contain various surface active agents as coating aids or antistatic agents or for improvement of lubrication, improvement of emulsifying dispersibility, prevention of adhesion, improvement of photographic characteristics (e.g., acceleration of development, increase of contrast, and increase of sensitivity).

Examples of the surface active agent to be added include nonionic surface active agents, such as saponin (steroid type), alkylene oxide derivatives (e.g., polyethylene glycol, polyethylene glycol/polypropylene glycol condensation products, polyethylene glycol alkyl ethers or alkylaryl ethers, polyethylene glycol esters, polyethylene glycol sorbitan esters, polyalkylene glycol alkylamines or amides, silicon-polyethylene oxide adducts), glycidol derivatives (e.g., alkenylsuccinic polyglycerides, alkylphenyl polyglycerides), fatty acid esters of polyhydric alcohols, and alkyl esters of sugars; anionic surface active agents containing an acid group (e.g., carboxyl, sulfo, phospho, sulfate and phosphate groups), such as alkylcarboxylates, alkyl sulfonates, alkylbenzenesulfonates, alkylnaphthalenesulfonates, alkylsulfates, alkyl phosphates, N-acyl-N-alkyltaurines, sulfosuccinates, sulfoalkylpolyoxyethylene alkylphenyl ethers, polyoxyethylene alkyl phosphates; amphoteric surface active agents, such as amino acids, aminoalkylsulfonic acids, aminoalkyl sulfates or phosphates, alkylbetaines, amine oxides; and cationic surface active agents, such as alkylamine salts, aliphatic or aromatic quaternary ammonium salts, heterocyclic quaternary ammonium salts, e.g., pyridinium, imidazolium, and aliphatic or heterocyclic phosphonium or sulfonium salts.

For the purpose of increasing sensitivity or contrast or accelerating development, the photographic emulsion layers may contain, for example, polyalkylene oxides or derivatives thereof (e.g., ethers, esters and. amides), thioether compounds, thiomorpholines, quaternary ammonium salt compounds, urethane derivatives, urea derivatives, imidazole derivatives, 3-pyrazolidones, etc.

The photographic layers of the light-sensitive materials according to the present invention can contain color image-forming couplers, i.e., compounds capable of developing a color upon oxidative coupling with an aromatic primary amine developing agent, such as phenylenediamine derivatives, aminophenol derivatives, and so on. For example, magenta-forming couplers include 5-pyrazolone couplers, pyrazolobenzimidazole couplers, cyanoacetylcoumarone couplers, and open chain acylacetonitrile couplers. Yellow-forming couplers include acylacetamide couplers (e.g., benzoylacetanilides and pivaloylacetanilides). Cyan-forming couplers include naphthol couplers and phenol couplers. Couplers that are nondiffusible due to a hydrophobic group called a ballast group are preferred. The couplers may be either 2-equivalent or 4-equivalent to a silver ion. In addition to the color-forming couplers, the photographic materials may further contain colored couplers having a color correction effect, couplers capable of releasing a development inhibitor on development ("DIR couplers"), or colorless DIR coupling compounds which produce a colorless coupling reaction product and release a development inhibitor.

The photographic material of the present invention can contain known color fog inhibitors, e.g., hydroquinone derivatives, aminophenol derivatives, gallic acid derivatives and ascorbic acid derivatives.

The hydrophilic colloidal layers of the photographic material of the present invention can contain an ultraviolet absorbent, such as benzotriazole compounds substituted with an aryl group (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A-46-2784), cinnamic esters (e.g., those described in U.S. Pat. Nos. 3,705,805 and 3,707,375), butadiene compounds (e.g., those described in U.S. Pat. No. 4,045,229), and benzoxidol compounds (e.g., those described in U.S. Pat. No. 3,700,455). In addition, the compounds described in U.S. Pat. No. 3,499,762 and JP-A-54-48535 can also be used. In addition, ultraviolet absorbing couplers (e.g., $\alpha$-naphthol type cyan couplers) or ultraviolet absorbing polymers may also be employed. A specific layer may be mordanted with these ultraviolet absorbents.

In carrying out the present invention, the following known discoloration inhibitors may be used in combination. The dye image stabilizers may be used either individually or in combination of two or more thereof. The known discoloration inhibitors include hydroquinone derivatives, gallic acid derivatives, p-alkoxyphenols, p-hydroxyphenol derivatives and bisphenol derivatives.

In addition to the above-mentioned additives, the photographic materials according to the present invention can contain other various known additives, such as brightening agents, desensitizers, plasticizers, slip agents, matting agents, oils and mordants. Specific examples of useful additives are described in *Research Disclosure*, No. 17643, 22-31 (December, 1978).

The present invention is applicable to various color and black-and-white silver halide photographic materials, including color positive films, color papers, color negative films, color reversal materials (some containing couplers and some not), light-sensitive materials for plate-making (e.g., lith films), light-sensitive materials for cathode ray tube displays, X-ray films (especially for direct or indirect photographing), light-sensitive materials for a colloid transfer process, a silver salt diffusion transfer process, a dye transfer process, a silver dye bleach process, a print-out paper process or a heat development process.

The light exposure for obtaining a photographic image can be effected in a usual manner. Any of known light sources including infrared light can be used, for example, natural light (sunlight), a tungstem lamp, a fluorescent lamp, a mercury lamp, a xenon arc lamp, a carbon arc lamp, a xenon flash lamp, a cathode ray tube flying spot, a light-emitting diode, a laser beam (e.g., a gas laser, a YAG laser, a dye laser or a semiconductor laser). The exposure may also be effected using light emitted from a fluorescent substance excited by electron beams, X-rays, Y-rays or $\gamma$-rays. The exposure time ranges from 1/1,000 to 1 second as is usually employed for photographing with cameras. A shorter exposure time, e.g., $1\times10^{-4}$ to $1\times10^{-6}$ second, is also employable with a xenon flash lamp or a cathode ray tube, or a longer exposure may also be used. If desired, the spectral composition of light for exposure can be controlled by the use of a color filter.

The photographic materials of the present invention can be subjected to development processing according to known methods using known processing solutions as described, e.g., in *Research Disclosure,* No. 17643, 28-30. Depending on purposes, either of black-and-white photographic processing for forming a silver image or color photographic processing for forming a color image can be applied.

Embodiment (II) according to the present invention will be described in greater detail below.

In this embodiment, the selective chemical sensitization of the (100) plane can be carried out in the same manner as described with respect to embodiment (I).

Determination of a dye which is selectively adsorbed more onto a (100) plane than on a (111) plane of silver halide grains and a dye which is selectively adsorbed more onto a (111) plane than on a (100) plane as used in method (A) can also be carried out in the same manner as described in embodiment (I).

The dye to be used here for selective adsorption onto a (100) plane can preferably be selected from methine dyes including cyanine dyes and merocyanine dyes, more preferably from cyanine dyes. Particularly preferred are benzoxacyanine, benzimidacyanine, benzoxaimidacyanine, benzoxathiacyanine, benzimidathiacyanine, benzoxaselenacyanine, benzimidaselenacyanine; and benzothiacyanine, benzoselenacyanine or benzothiaselenacyanine, each of which may have a substituent other than halogen atoms at the 5-position of the benzene nucleus. Particularly preferred of these dyes are those forming J-aggregates on the surface of silver halide grains.

Typical examples of these methine dyes are shown below.

E-1

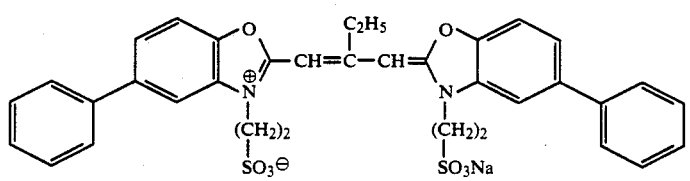

E-2

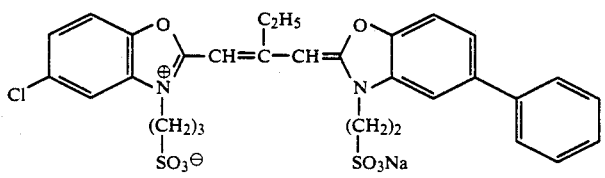

E-3

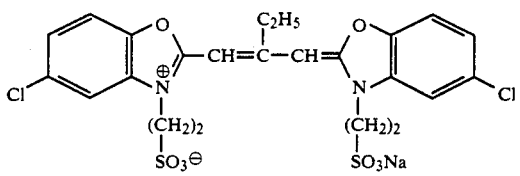

E-4

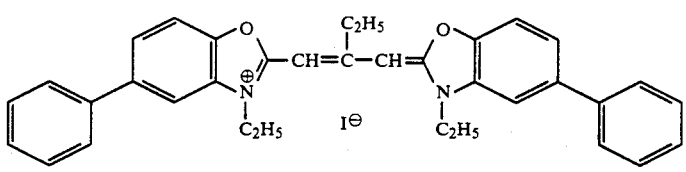

E-5

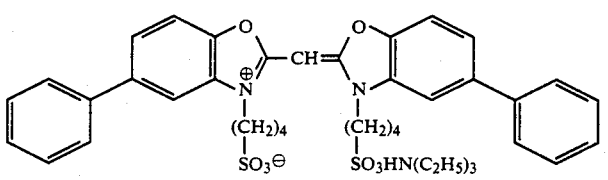

E-6

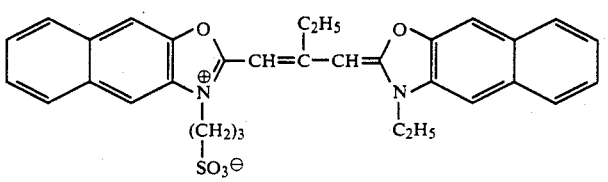

-continued
E-7
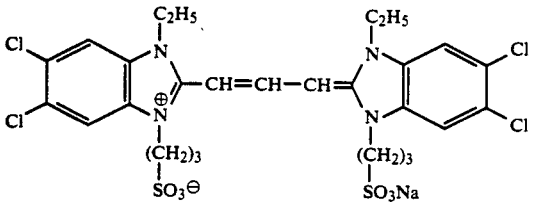
E-8
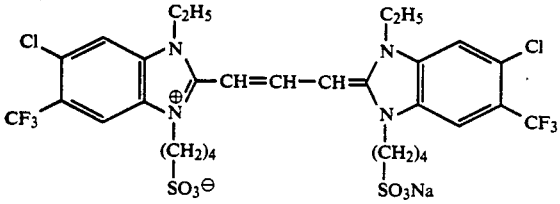
E-9
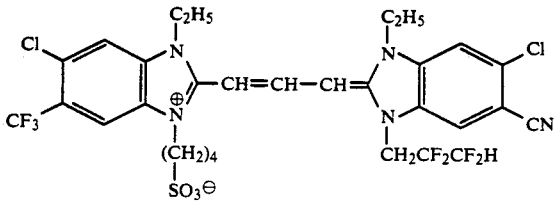
E-10
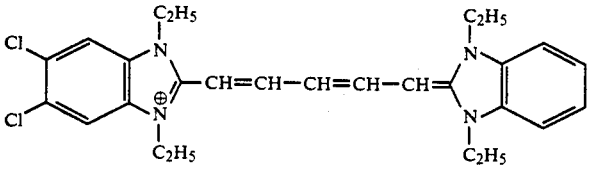
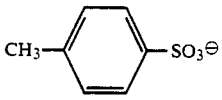
E-11
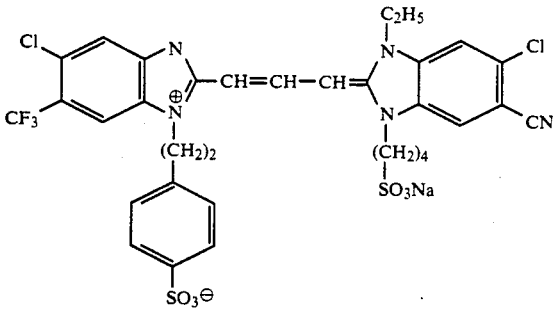
E-12
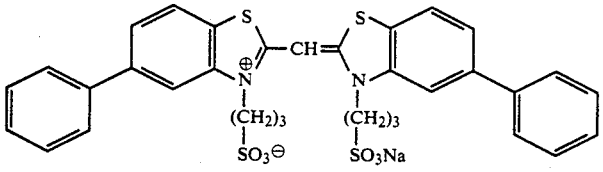
E-13
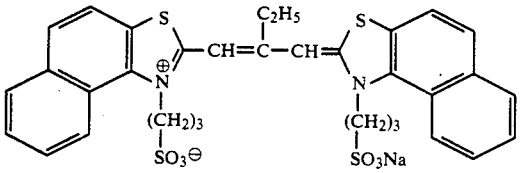

-continued
E-14
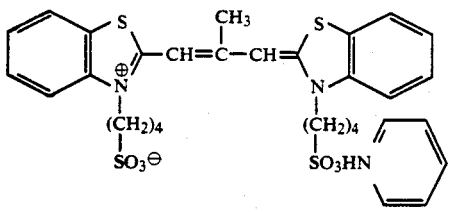
E-15
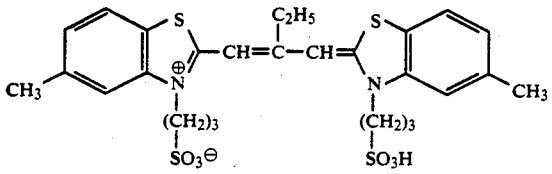
E-16
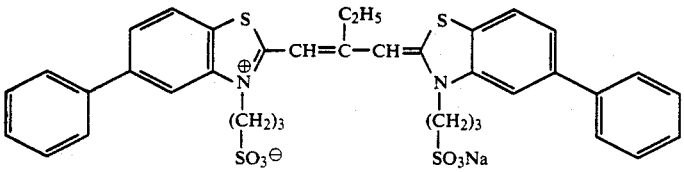
E-17
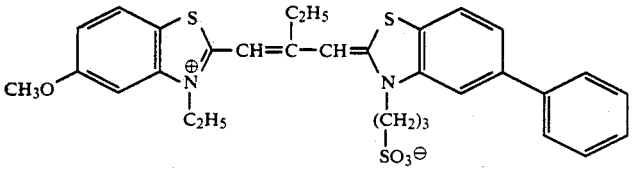
E-18
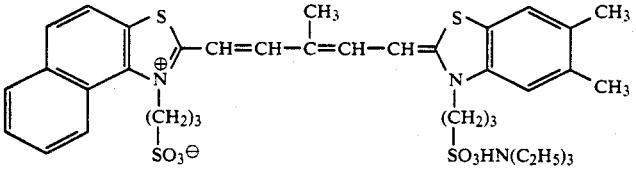
E-19
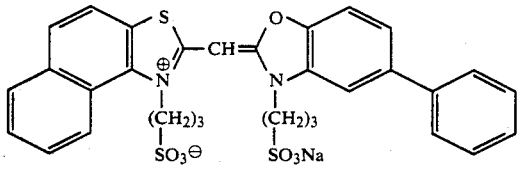
E-20
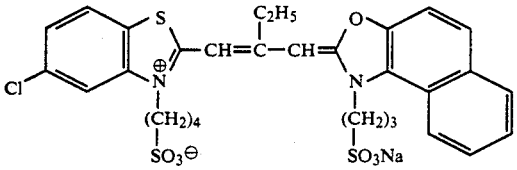
E-21
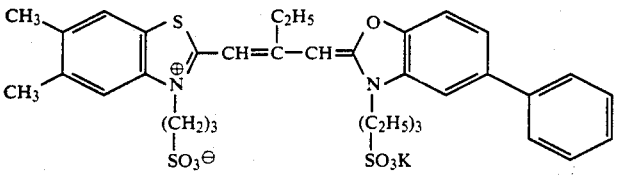

-continued
E-22
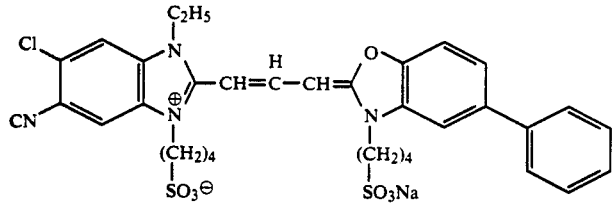
E-23
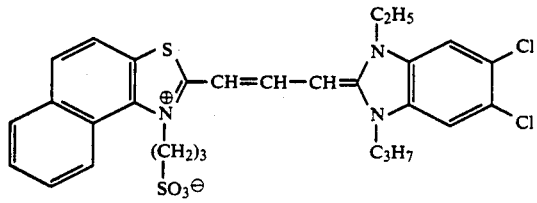
E-24
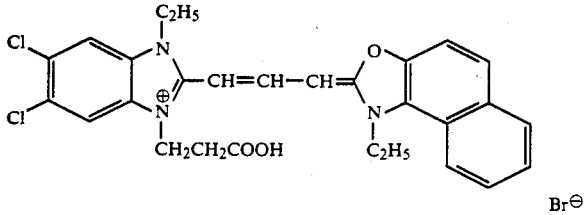
E-25
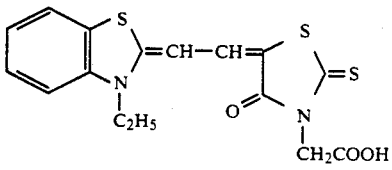
E-26
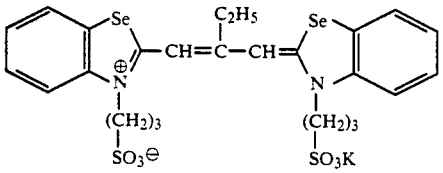
E-27
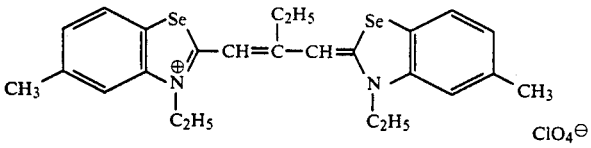
E-28
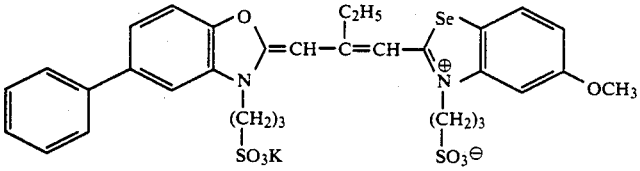
E-29
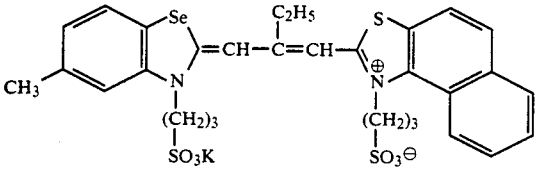

-continued

E-30

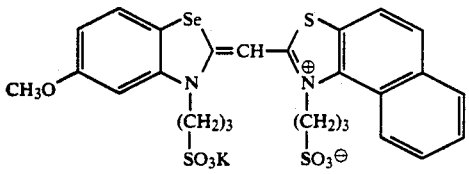

The dye to be used here for selective adsorption onto a (111) plane instead of a (100) plane preferably includes cyanine dyes, more preferably thiacyanine dyes, selenacyanine dyes, quinocyanine dyes, thiaquinocyanine dyes and selenaquinocyanine dyes.

These dyes for selective adsorption either onto the (100) plane or onto the (111) plane are used in an amount of from $1\times10^{-7}$ to $2\times10^{-3}$ mol, preferably from $1\times10^{-6}$ to $1\times10^{-3}$ mol, per mol of silver. The amount Of the former dye is preferably at least an amount sufficient for saturating the (100) planes and not more than an amount for saturating all the (100) planes and the (111) planes. The amount of the latter dye is preferably at least an amount enough to saturate the (111) planes.

Silver halide to be used in embodiment (II) may be any of silver bromide, silver iodobromide, silver iodochlorobromide, silver chlorobromide, silver iodide and silver chloride, with silver bromide, silver iodobromide, silver iodochlorobromide, and silver chlorobromide being particularly preferred. The bromine content is preferably 50 mol % or more, more preferably 70 mol % or more. The iodine content is preferably 38 mol % or less, more preferably 20 mol % or less. The chlorine content is preferably 50 mol % or less, more preferably 30 mol % or less.

Other constructional factors of embodiment (II) are the same as in embodiment (I).

Embodiment (III) according to the present invention will be described in greater detail below.

A silver halide emulsion which can be used in embodiment (III) contains substantially normal crystal grains, with at least about 60%, preferably at least about 65%, more preferably at least about 70%, of the surface of the substantially normal crystal grains being composed of a (100) plane. The area occupied by a (111) plane is preferably not more than about 40%, more preferably not more than about 35%.

The silver halide to be used here may be any of silver bromide, silver iodobromide, silver iodochlorobromide, silver chlorobromide, silver iodide and silver chloride, with silver bromide, silver iodobromide, silver iodochlorobromide and silver chlorobromide being particularly preferred. The bromine content is preferably 50 mol % or more, more preferably 70 mol % or more. The iodine content is preferably 38 mol % or less, more preferably 20 mol % or less. The chlorine content is preferably 50 mol % or less, more preferably 30 mol % or less.

Other constructional factors of embodiment (III) are the same as in embodiment (I).

The present invention is now illustrated in greater detail with reference to the following examples, but the present invention is not to be construed as being limited thereto. Unless otherwise indicated, all parts, percents and ratios are by weight.

EXAMPLE 1

To a gelatin aqueous solution kept at 60° C. under vigorous stirring was added ammonia (25 wt %, 6 cc), and a silver nitrate aqueous solution (0.88 mol) and a potassium bromide aqueous solution (0.90 mol) were then added thereto simultaneously. During the addition, the pAg value of the system was maintained at 7.9. The resulting emulsion was washed with water and desalted according to a known flocculation method and then adjusted to a pH of 6.3 and a pAg of 8.5 to obtain a monodisperse tetradecahedral silver bromide emulsion having a grain size of about 0.8 μm.

The area proportions of (100) planes and (111) planes of the resulting emulsion were found to be 52% and 48%, respectively, as determined in accordance with the method described in *Nippon Kagaku Kaishi*, No. 6, 942 (1984).

Each of the chemical sensitizers shown in Table 1 below was added to the emulsion in an amount indicated, and the emulsion was subjected to chemical ripening at 60° C. for 60 minutes.

Thereafter, sodium dodecylbenzenesulfonate as a coating aid, potassium poly(4-sulfostyrene) as a thickener, and sodium 2,4-dichloro-6-hydroxy-s-triazine as a hardening agent were added to the emulsion. The resulting coating composition was coated on a cellulose acetate film support together with a gelatin protective layer by a simultaneous extrusion method, followed by drying. The resulting samples were designated as Samples 1 to 8.

Each of Samples 1 to 8 was exposed to light for 1 second through an optical wedge and developed with a developer "MAA-1" produced by Eastman Kodak Co., Ltd. at 20° C. for 10 minutes.

Then, each of the samples was uniformly exposed to light at an exposure 100 times as exposure which provided a midpoint density of the characteristic curve obtained by the above-described development with "MAA-1", i.e., $(D_{max}-\text{fog})\times\frac{1}{2}$, and then was developed with an arresting developer having the same formulation as described above at 20° C. for 10 minutes. After the development was stopped with a 5 wt % aqueous solution of acetic acid, the emulsion layer was removed from the coating by decomposing with pronase, and undeveloped silver halide grains were removed therefrom to prepare a carbon replica.

Figure 2:
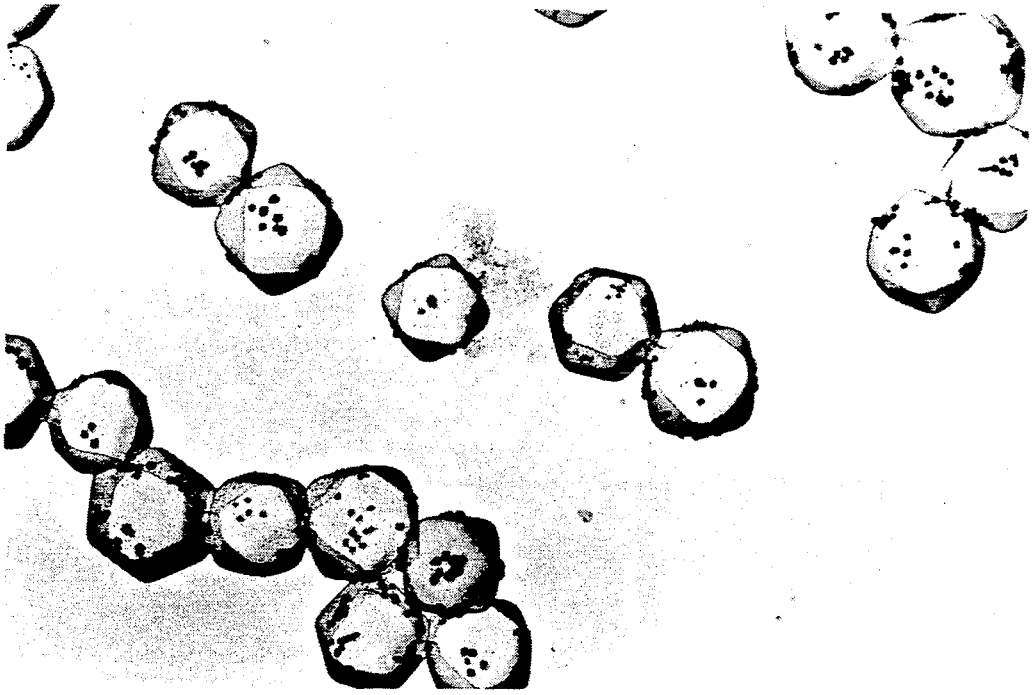

Electron micrographs taken of Samples 1 and 2 are shown in FIGS. 1 and 2, respectively.

The plane or site on which the developed silver specks were observed under an electron microscope for each of Samples 1 to 8 is shown in Table 1.

TABLE 1

| Sample No. | Chemical Sensitizer | Amount of Chemical Sensitizer (mol/mol of AgX) | Site of Developed Silver Formation |
|---|---|---|---|
| 1 | Sodium | $1.6\times10^{-5}$ | (111) plane |

TABLE 1-continued

| Sample No. | Chemical Sensitizer | Amount of Chemical Sensitizer (mol/mol of AgX) | Site of Developed Silver Formation |
|---|---|---|---|
| | Thiosulfate | | |
| 2 | S-2 | $8 \times 10^{-6}$ | (100) plane |
| 3 | S-2 | $1.6 \times 10^{-5}$ | (100) plane |
| 4 | S-3 | $8 \times 10^{-6}$ | (100) plane |
| 5 | S-4 | $2.0 \times 10^{-5}$ | (100) plane |
| 6 | S-5 | $8 \times 10^{-6}$ | (100) plane to the corner edges |
| 7 | S-10 | $1.6 \times 10^{-5}$ | (100) plane to the edges, little on (111) plane |
| 8 | S-12 | $2.0 \times 10^{-5}$ | (100) plane to the corner edges |

As is apparent from Table 1, the chemical sensitizers according to the present invention, S-2, S-3, S-4, S-5, S-10 and S-12, formed developed silver specks on the (100) plane to the corner edges, while sodium thiosulfate formed developed silver specks on the (111) plane.

Thus, the site where the chemical sensitizer selectively forms chemical sensitization nuclei where a latent image is to be formed can be judged.

EXAMPLE 2

A monodisperse emulsion of octahedral silver iodobromide grains (iodine content: 1 mol %) having a grain size of 2 μm and a monodisperse emulsion of cubic silver iodobromide grains (iodine content: 1 mol %) having a grain size of 0.5 μm were prepared. The two emulsions were mixed to prepare a mixed emulsion having (111) planes and (100) planes in equal proportions.

The mixed emulsion was spectrally sensitized with each of the sensitizing dyes shown in Table 2 at a pH of 6.5, a pAg of 8 and a temperature of 60° C. for 30 minutes, the dye being added in an amount of $10\times10^{-5}$ mol per mol of silver iodobromide which corresponded to an amount covering about 20% of the total surface area of silver iodobromide grains, taking the surface area of the grains being 70 $Å^2$ per molecule. The thus-sensitized emulsion was filtered through a filter having a pore size of 0.8 μm, and the amount of the adsorbed dye in the filtrate (emulsion of cubic grains) was determined. The ratio of the amount of the dye adsorbed to the cubic grains or the octahedral grains to the amount of the dye added is shown in Table 2.

TABLE 2

| Dye | Ratio of Dye Adsorbed Based on Added Dye: On Cubic Grains (%) | On Octahedral Grains (%) |
|---|---|---|
| Comparative Dye (A) | ca. 100 | ca. 0 |
| D-2 | 5 | 95 |
| D-6 | ca. 0 | ca. 100 |
| D-8 | ca. 0 | ca. 100 |
| D-10 | 5 | 95 |
| D-13 | 28 | 72 |
| D-17 | 25 | 75 |
| D-20 | ca. 0 | ca. 100 |
| D-22 | 10 | 90 |
| D-23 | 5 | 95 |

Comparative Dye (A):

TABLE 2-continued

| Dye | Ratio of Dye Adsorbed Based on Added Dye: On Cubic Grains (%) | On Octahedral Grains (%) |
|---|---|---|

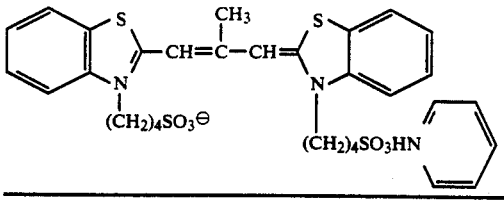

(dye described in *Nippon Kagaku Kaishi,* No. 6, 942 (1984))

The results of Table 2 reveal that almost the whole amount of Comparative Dye (A) was adsorbed on the surface of the cubic grains, while the dyes according to the present invention, D-2, D-6, D-8, D-10, D-13, D-17, D-20, D-22 and D-23, were not substantially adsorbed or, if any, a little adsorbed on the cubic grains. From these results, these sensitizing dyes of the present invention prove to be selectively adsorbed on the (111) plane.

EXAMPLE 3

The same tetradecahedral silver bromide emulsion as used in Example 1 was chemically sensitized with a sulfur sensitizer as shown in Table 3 at 60° C. for 60 minutes. To the chemically sensitized emulsion was added a sensitizing dye of the invention, D-8, in an amount of $3\times10^{-4}$ mol per mol of silver bromide Thereafter, (4-hydroxy-6-methyl-1,3,3a,7-tetraazaindene) was added thereto as a stabilizer in an amount of $3\times10^{-3}$ mol per mol of silver bromide, and the same coating aid, thickener and hardening agent as used in Example 1 were further added. The resulting coating composition was coated on a cellulose acetate film support simultaneously with a gelatin protective layer. The resulting samples were designated as Samples 10 to 14.

Each of Samples 10 to 14 was exposed to light through an optical wedge and a yellow filter and developed with a developer "Hilendol" (produced by Fuji Photo Film Co., Ltd.) at 20° C. for 4 minutes. The sensitivity of the sample was obtained as the reciprocal of an exposure necessary for obtaining a density of fog +0.2 and relatively expressed taking the sensitivity of Sample 10 (comparative sample) as a standard (100). The results obtained are shown in Table 3.

Separately, the samples were subjected to arrested development in the same manner as in Example 1 to judge the site where fine silver specks were formed, and the results obtained are also shown in Table 3.

TABLE 3

| Sample No. | Chemical Sensitizer | Amount of Chemical Sensitizer (mol/mol-Ag) | Relative Sensitivity | Site of Latent Image Formation |
|---|---|---|---|---|
| 10 | Sodium Thiosulfate (comparison) | $1.6 \times 10^{-5}$ | 100 | (111) plane |
| 11 | S-2 | $8 \times 10^{-6}$ | 795 | (100) plane |
| 12 | S-3 | $8 \times 10^{-6}$ | 890 | (100) plane |
| 13 | S-5 | $8 \times 10^{-6}$ | 630 | (100) plane to the corner edges |
| 14 | S-10 | $1.6 \times 10^{-5}$ | 570 | (100) plane to the |

TABLE 3-continued

| Sample No. | Chemical Sensitizer | Amount of Chemical Sensitizer (mol/mol-Ag) | Relative Sensitivity | Site of Latent Image Formation |
|---|---|---|---|---|
| | | | | corner edges |

As is apparent from Table 3, the photographic sensitivity was markedly increased when a latent image was formed on the plane other than the (111) plane, i.e., the (100) plane.

EXAMPLE 4

A monodisperse tetradecahedral silver iodobromide emulsion (iodine content: 2 mol %, grain size: about 0.6 μm) composed of 38% of a (100) plane and 62% of a (111) plane was prepared in the same manner as described in Example 1, except for maintaining the grain formation system at a pAg of 8.1. After water washing and desalting, the emulsion was adjusted to a pH of 6.5 and a pAg of 8.5.

The resulting emulsion was divided into four portions, designated as Emulsions A, B, C and D.

Emulsion A was chemically sensitized with sodium thiosulfate, chloroauric acid and potassium thiocyanate at 60° C. for 60 minutes, and then a sensitizing dye of the invention (D-8) and two kinds of sensitizing dye having the formulae shown below were added thereto in amounts of $3.5\times10^{-4}$ mol, $1\times10^{-5}$ mol, and $1\times10^{-4}$ mol, each per mol of silver.

Sensitizing Dye:

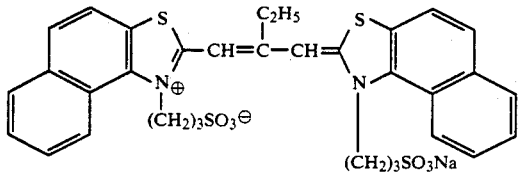

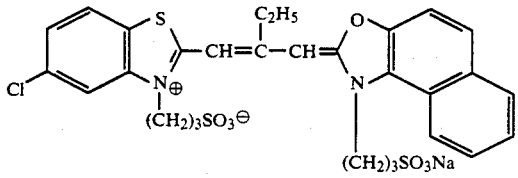

On examination of the above-described two dyes in accordance with the method described above they were found to be selectively adsorbed on the (100) plane.

Emulsion B was chemically sensitized with a sulfur sensitizer, S-2, chloroauric acid and potassium thiocyanate, and the same three dyes as used for Emulsion A were then added thereto.

To Emulsion C was added D-8, and the emulsion was chemically sensitized with sodium thiosulfate, chloroauric acid, and potassium thiocyanate at 60° C. for 60 minutes. Then, the two other dyes were added thereto.

To Emulsion D was added D-8, and the emulsion was chemically sensitized with S-2, chloroauric acid, and potassium thiocyanate at 60° C. for 60 minutes. Then, the two other dyes were added thereto.

To each of the emulsions were added couplers (C-6 and C-7), dispersing oils (Oil-1 and Oil-2), an antifoggant (1-(m-sulfophenyl)-5-mercaptotetrazole monosodium salt), and a stabilizer (4-hydroxy-6-methyl-1,3,3a,7-tetraazaindene). The same coating aid, thickener and hardening agent as used in Example 1 were further added thereto. The resulting coating composition was coated on a cellulose acetate film support together with a gelatin protective layer.

The resulting sample was exposed to light through an optical wedge and a yellow filter and subjected to color development processing according to the procedure shown below at 38° C.

The compounds used in the sample preparation were as follows.

C-6:

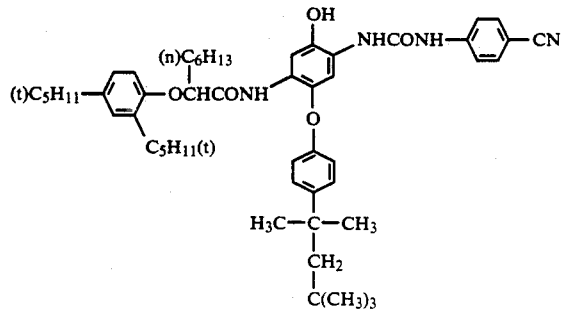

C-7:

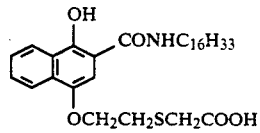

Oil-1: Tricresyl phosphate
Oil-2: Dibutyl phthalate

Processing Procedure:

| | |
|---|---|
| Color Development | 2 min 45 sec |
| Bleach | 6 min 30 sec |
| Washing | 2 min 10 sec |
| Fixation | 4 min 20 sec |
| Washing | 3 min 15 sec |
| Stabilization | 1 min 05 sec |

Color Developer Formulation:

| | |
|---|---|
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1.0 liter |
| | pH = 10.0 |

Bleaching Solution Formulation:

| | |
|---|---|
| Ammonium (Ethylenediaminetetraacetato)Ferrite | 100.0 g |
| Disodium Ethylenediaminetetraacetate | 10.0 g |
| Ammonium Bromide | 150.0 g |
| Ammonium Nitrate | 10.0 g |
| Water to make | 1.0 liter |
| | pH = 6.0 |

Fixing Solution Formulation:

| | |
|---|---|
| Disodium Ethylenediaminetetraacetate | 1.0 g |
| Sodium Sulfite | 4.0 g |
| Ammonium Thiosulfate (70 wt % aq. soln.) | 175.0 ml |
| Sodium Bisulfite | 4.6 g |
| Water to make | 1.0 liter |
| | pH = 6.6 |

Stabilizer Formulation:

| | |
|---|---|
| Formalin (40 wt %) | 2.0 ml |

-continued

| | |
|---|---|
| Polyoxyethylene-p-monononylphenyl Ether (average degree of polymerization: 10) | 0.3 g |
| Water to make | 1.0 liter |

The relative sensitivity of each sample is shown in Table 4 below, tanking the sensitivity of Emulsion A as a standard (100). The site for latent image formation was determined in the same manner as in Example 2 and is also shown in Table 4.

TABLE 4

| Emulsion | Relative Sensitivity | Site of Latent Image Formation | Remarks |
|---|---|---|---|
| A | 100 | Predominantly on (111) plane, a few on (100) plane | Comparison |
| B | 131 | Predominantly on (100) plane, a few on (111) plane | Invention |
| C | 148 | Predominantly on (100) plane | Invention |
| D | 153 | Predominantly on (100) plane | Invention |

As is apparent from the Table, when the emulsion contained a large amount of D-8 which is selectively adsorbed on (111) plane, the site for latent formation was predominantly formed on the plane other than the (111) plane, i.e., the (100) plane, and the emulsion had high sensitivity.

EXAMPLE 5

Emulsions A and D as prepared in Example 4 were treated in the same manner as in Example 4, except for replacing D-8 with D-17, D-18 or D-20, and tested in the same manner as in Example 4. As a result, Emulsion D proved more highly sensitive than Emulsion A in each case.

EXAMPLE 6

Silver bromide was grown as an outer shell on seed crystals of silver iodobromide having an iodine content of 30 mol % to prepare Emulsion E and Emulsion F comprising core/shell grains both having a silver iodide content of 10 mol % and each having a grain size of 0.7 μm and 1.5 μm, respectively.

Emulsion E grains were composed of 20% of a (100) plane and 80% of a (111) plane, while Emulsion F grains were composed of 15% of a (100) plane and 85% of a (111) plane, both being monodisperse tetradecahedra close to octahedra.

After adjustment to a pH of 6.3 and a pAg of 8.9, each of Emulsions E and F was divided into two portions, designated as Emulsions E-1 and E-2 and Emulsions F-1 and F-2, respectively.

Emulsion E-1 was chemically sensitized with sodium thiosulfate and chloroauric acid, and Dyes I, II and III were added thereto. To Emulsion E-2 was first added Dye II (corresponding to D-8), the emulsion was sensitized with sodium thiosulfate and chloroauric acid, and Dyes I and III were then added thereto.

Emulsion F-1 was chemically sensitized with sodium thiosulfate and chloroauric acid, and Dye IX was then added thereto. To Emulsion F-2 was added Dye IX (corresponding to D-2) and the emulsion was then chemically sensitized with a sulfur sensitizer, S-3, and chloroauric acid.

Each of these sensitized emulsions was coated on a support in a single layer. On examination by the arrested development process in the same manner as in Example 2, it was proved that Emulsions E-2 and F-2 both formed fine developed silver specks in the neighborhood of the corners of individual grains, i.e., on the (100) plane while Emulsions E-1 and F-1 both formed developed silver specks over the entire surface of the grains.

A multilayer color light-sensitive material having a layer structure described below was prepared using Emulsion,E-1 in the fifth layer and Emulsion F-1 in the twelfth layer or using Emulsion E-2 in the fifth layer and Emulsion F-2 in the twelfth layer. The resulting samples were designated as Sample 20 and Sample 21, respectively.

Each of Samples 20 and 21 was exposed to light at 25 CMS using a tungsten lamp (color temperature adjusted to 4,800° K. through a filter) and subjected to development processing at 38° C. according to the following procedure.

| Processing Procedure: | |
|---|---|
| Color Development | 3 min 15 sec |
| Bleach | 6 min 30 sec |
| Washing | 2 min 10 sec |
| Fixation | 4 min 20 sec |
| Washing | 3 min 15 sec |
| Stabilization | 1 min 05 sec |

The processing solutions used in the development processing had the same formulations as used in Example 4.

| Layer Structure: | |
|---|---|
| First Layer: Antihalation Layer | |
| Black colloidal silver | 0.2 g-Ag/m$^2$ |
| Gelatin | 1.3 g/m$^2$ |
| Colored coupler, C-1 | 0.06 g/m$^2$ |
| Ultraviolet absorbent, UV-1 | 0.1 g/m$^2$ |
| Ultraviolet absorbent, UV-2 | 0.2 g/m$^2$ |
| Dispersing oil, Oil-1 | 0.01 g/m$^2$ |
| Dispersing oil, Oil-2 | 0.01 g/m$^2$ |
| Second Layer: Intermediate Layer | |
| Silver bromide fine grains (mean grain size: 0.07 μm) | 0.15 g-Ag/m$^2$ |
| Gelatin | 1.0 g/m$^2$ |
| Colored coupler, C-2 | 0.02 g/m$^2$ |
| Dispersing oil, Oil-1 | 0.1 g/m$^2$ |
| Third Layer: | |
| First Red-Sensitive Emulsion Layer | |
| Silver iodobromide emulsion (silver iodide: 2 mol %, mean grain size: 0.3 μm) | 0.4 g-Ag/m$^2$ |
| Gelatin | 0.6 g/m$^2$ |
| Sensitizing Dye I | $1.0 \times 10^{-4}$ mol/mol-AgX |
| Sensitizing Dye II | $3.0 \times 10^{-4}$ mol/mol-AgX |
| Sensitizing Dye III | $1 \times 10^{-5}$ mol/mol-AgX |
| Coupler, C-3 | 0.06 g/m$^2$ |
| Coupler, C-4 | 0.06 g/m$^2$ |
| Coupler, C-8 | 0.04 g/m$^2$ |
| Coupler, C-2 | 0.03 g/m$^2$ |
| Dispersing oil, Oil-1 | 0.03 g/m$^2$ |
| Dispersing oil, Oil-3 | 0.012 g/m$^2$ |
| Fourth Layer: Second Red-Sensitive Emulsion Layer | |
| Silver iodobromide emulsion (silver iodide: 5 mol %, mean grain size: 0.5 μm) | 0.7 g-Ag/m$^2$ |
| Gelatin | 0.6 g/m$^2$ |
| Sensitizing Dye I | $1 \times 10^{-4}$ mol/mol-AgX |
| Sensitizing Dye II | $3 \times 10^{-4}$ mol/mol-AgX |
| Sensitizing Dye III | $1 \times 10^{-5}$ mol/mol-AgX |

-continued

| Layer Structure: | | |
|---|---|---|
| Coupler, C-3 | 0.24 | $g/m^2$ |
| Coupler, C-4 | 0.24 | $g/m^2$ |
| Coupler, C-8 | 0.04 | $g/m^2$ |
| Coupler, C-2 | 0.04 | $g/m^2$ |
| Dispersing oil, Oil-1 | 0.15 | $g/m^2$ |
| Dispersing oil, Oil-3 | 0.02 | $g/m^2$ |
| Fifth Layer: Third Red-Sensitive Emulsion Layer | | |
| Emulsion E (silver iodide: 10 mol %, mean grain size: 0.7 μm) | 1.0 | $g\text{-}Ag/m^2$ |
| Gelatin | 1.0 | $g/m^2$ |
| Sensitizing Dye I | $1 \times 10^{-4}$ | mol/mol-AgX |
| Sensitizing Dye II (corresponding to D-8) | $3 \times 10^{-4}$ | mol/mol-AgX |
| Sensitizing Dye III | $1 \times 10^{-5}$ | mol/mol-AgX |
| Coupler, C-5 | 0.05 | $g/m^2$ |
| Coupler, C-7 | 0.1 | $g/m^2$ |
| Dispersing-oil, Oil-1 | 0.01 | $g/m^2$ |
| Dispersing oil, Oil-2 | 0.05 | $g/m^2$ |
| Sixth Layer: Intermediate Layer | | |
| Gelatin | 1.0 | $g/m^2$ |
| Compound, Cpd-A | 0.03 | $g/m^2$ |
| Dispersing oil, Oil-1 | 0.05 | $g/m^2$ |
| Seventh Layer: First Green-Sensitive Emulsion Layer | | |
| Silver iodobromide emulsion (silver iodide: 4 mol %, mean grain size: 0.3 μm) | 0.30 | $g\text{-}Ag/m^2$ |
| Sensitizing Dye IV | $5 \times 10^{-4}$ | mol/mol-AgX |
| Sensitizing Dye VI | $0.3 \times 10^{-4}$ | mol/mol-AgX |
| Sensitizing Dye V | $2 \times 10^{-4}$ | mol/mol-AgX |
| Gelatin | 1.0 | $g/m^2$ |
| Coupler, C-9 | 0.2 | $g/m^2$ |
| Coupler, C-5 | 0.03 | $g/m^2$ |
| Coupler, C-1 | 0.03 | $g/m^2$ |
| Dispersing oil, Oil-1 | 0.5 | $g/m^2$ |
| Eighth Layer: Second Green-Sensitive Emulsion Layer | | |
| Silver iodobromide emulsion (silver iodide: 5 mol %, mean grain size: 0.5 μm) | 0.4 | $g\text{-}Ag/m^2$ |
| Sensitizing Dye IV | $5 \times 10^{-4}$ | mol/mol-AgX |
| Sensitizing Dye V | $2 \times 10^{-4}$ | mol/mol-AgX |
| Sensitizing Dye VI | $0.3 \times 10^{-4}$ | mol/mol-AgX |
| Coupler, C-9 | 0.25 | $g/m^2$ |
| Coupler, C-1 | 0.03 | $g/m^2$ |
| Coupler, C-10 | 0.015 | $g/m^2$ |
| Coupler, C-5 | 0.01 | $g/m^2$ |
| Dispersing oil, Oil-1 | 0.2 | $g/m^2$ |
| Ninth Layer: Third Green-Sensitive Emulsion Layer | | |
| Silver iodobromide emulsion (silver iodide: 6 mol %, mean grain size: 0.7 μm) | 0.85 | $g\text{-}Ag/m^2$ |
| Gelatin | 1.0 | $g/m^2$ |

-continued

| Layer Structure: | | |
|---|---|---|
| Sensitizing dye VII | $3.5 \times 10^{-4}$ | mol/mol-AgX |
| Sensitizing Dye VIII | $1.4 \times 10^{-4}$ | mol/mol-AgX |
| Coupler, C-11 | 0.01 | $g/m^2$ |
| Coupler, C-12 | 0.03 | $g/m^2$ |
| Coupler, C-13 | 0.20 | $g/m^2$ |
| Coupler, C-1 | 0.02 | $g/m^2$ |
| Coupler, C-15 | 0.02 | $g/m^2$ |
| Dispersing oil, Oil-1 | 0.20 | $g/m^2$ |
| Dispersing oil, Oil-2 | 0.05 | $g/m^2$ |
| Tenth Layer: Yellow Filter Layer | | |
| Gelatin | 1.2 | $g/m^2$ |
| Yellow colloidal silver | 0.08 | $g\text{-}Ag/m^2$ |
| Compound, Cpd-B | 0.1 | $g/m^2$ |
| Dispersing oil, Oil-1 | 0.3 | $g/m^2$ |
| Eleventh Layer: First Blue-Sensitive Emulsion Layer | | |
| Monodisperse silver iodobromide emulsion (silver iodide: 4 mol %, mean grain size: 0.3 μm) | 0.4 | $g\text{-}Ag/m^2$ |
| Gelatin | 1.0 | $g/m^2$ |
| Sensitizing Dye IX | $2 \times 10^{-4}$ | mol/mol-AgX |
| Coupler, C-14 | 0.9 | $g/m^2$ |
| Coupler, C-5 | 0.07 | $g/m^2$ |
| Dispersing oil, Oil-1 | 0.2 | $g/m^2$ |
| Twelfth Layer: Second Blue-Sensitive Emulsion Layer | | |
| Emulsion F (silver iodide: 10 mol %, mean grain size: 1.5 μm) | 0.5 | $g\text{-}Ag/m^2$ |
| Gelatin | 0.6 | $g/m^2$ |
| Sensitizing Dye IX (corresponding to D-2) | $1 \times 10^{-4}$ | mol/mol-AgX |
| Coupler, C-14 | 0.25 | $g/m^2$ |
| Dispersing oil, Oil-1 | 0.07 | $g/m^2$ |
| Thirteenth Layer: First Protective Layer | | |
| Gelatin | 0.8 | $g/m^2$ |
| Ultraviolet absorbent, UV-1 | 0.1 | $g/m^2$ |
| Ultraviolet absorbent, UV-2 | 0.2 | $g/m^2$ |
| Dispersing oil, Oil-1 | 0.01 | $g/m^2$ |
| Dispersing oil, Oil-2 | 0.01 | $g/m^2$ |
| Fourteenth Layer: Second Protective Layer | | |
| Fine silver bromide grains (mean grain size: 0.07 μm) | 0.5 | $g/m^2$ |
| Gelatin | 0.45 | $g/m^2$ |
| Polymethyl methacrylate particles (diameter: 1.5 μm) | 0.2 | $g/m^2$ |
| Hardening agent, H-1 | 0.4 | $g/m^2$ |
| Formaldehyde scavenger, S'-1 | 0.5 | $g/m^2$ |
| Formaldehyde scavenger, S'-2 | 0.5 | $g/m^2$ |

Each of the layers additionally contained a surface active agent as a coating aid.

The chemical formulae or names of the compounds used in sample preparation were as follows:

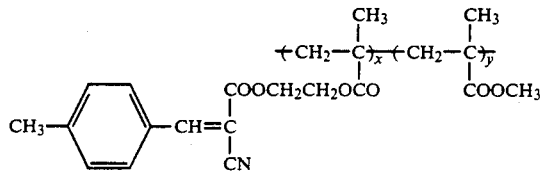

UV-1 x/y = 7/3 (by weight)

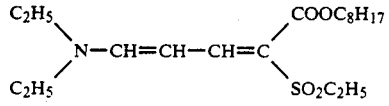

UV-2

| | |
|---|---|
| Tricresyl phosphate | Oil-1 |
| Dibutyl phthalate | Oil-2 |
| Bis(2-ethylhexyl) phthalate | Oil-3 |

-continued
C-1
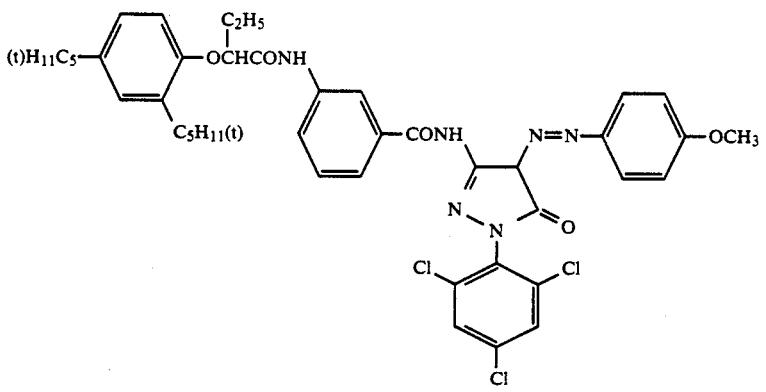
C-2
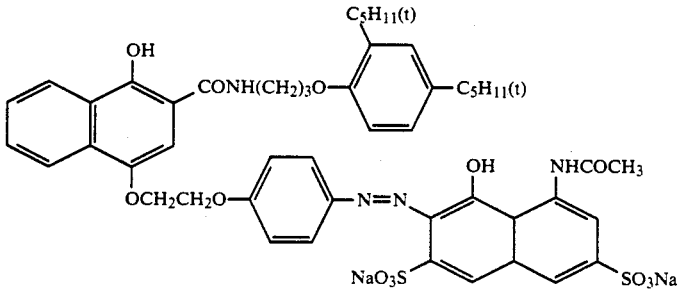
C-3
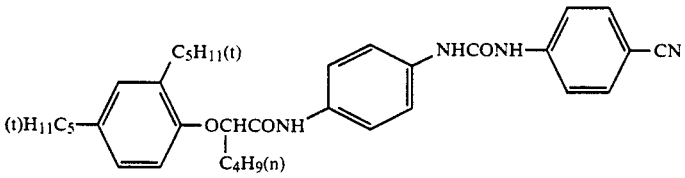
C-4
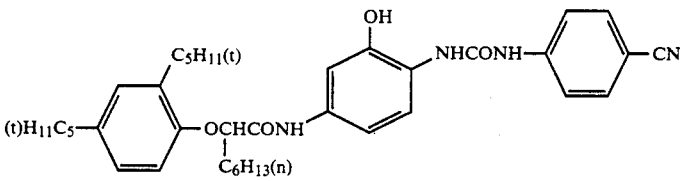
C-5
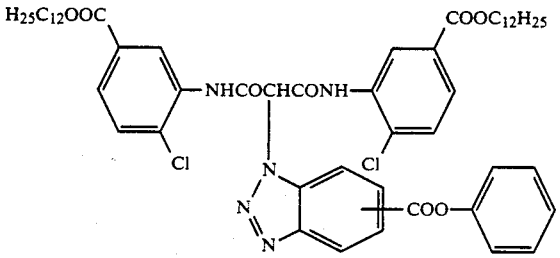

-continued
C-6
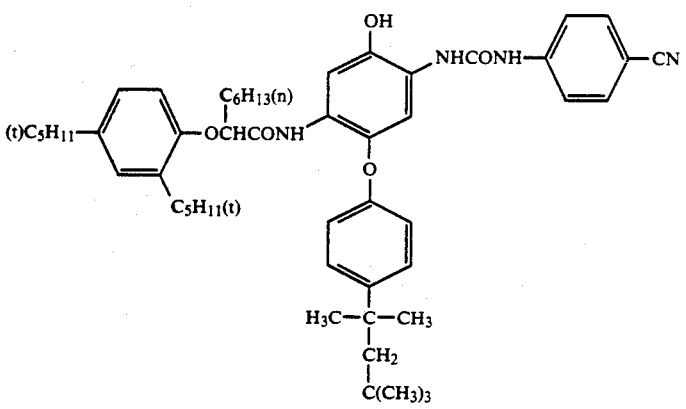
C-7
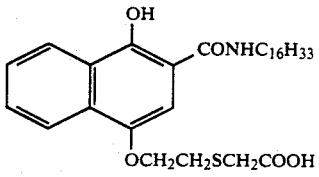
C-8
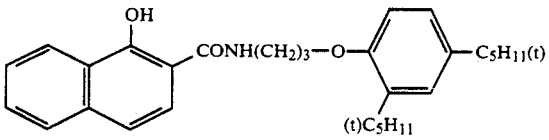
C-9
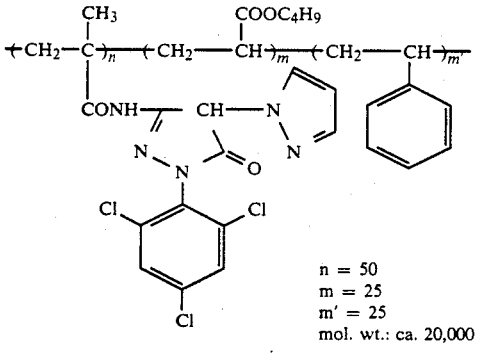
C-10
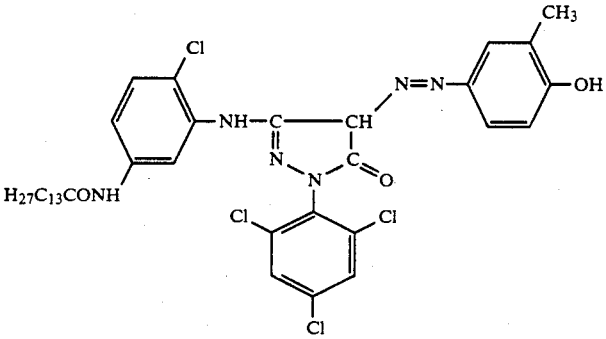

-continued
C-11
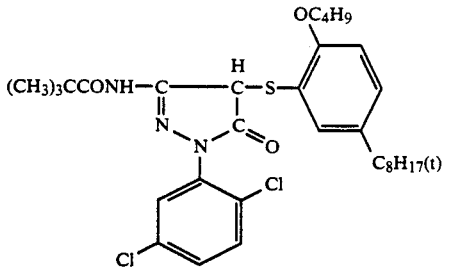
C-12
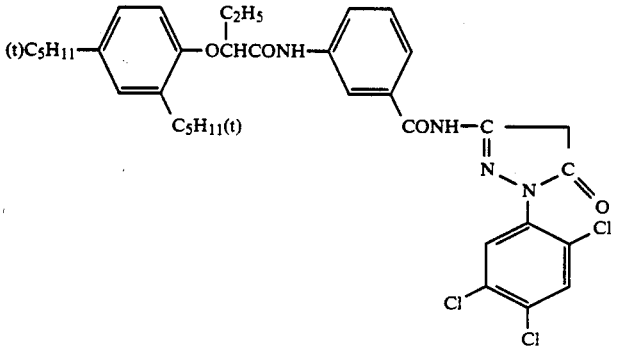
C-13
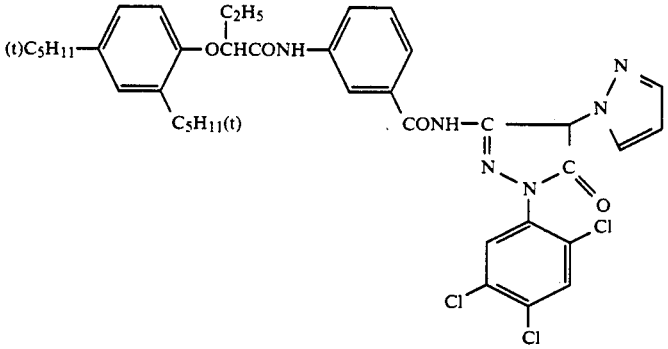
C-14
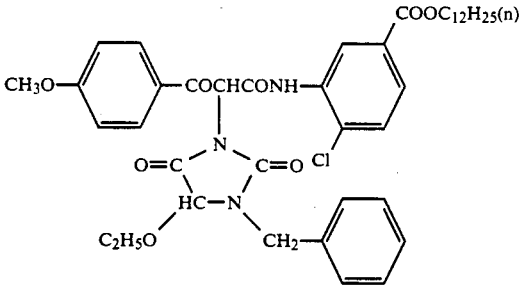
C-15
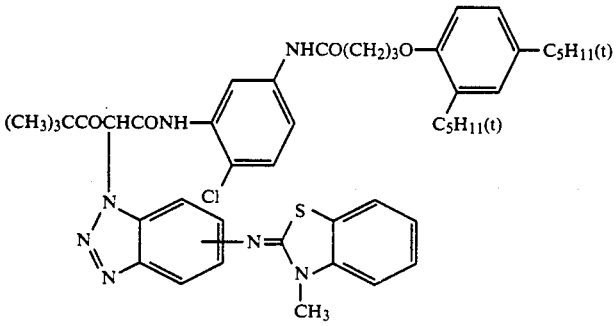

-continued
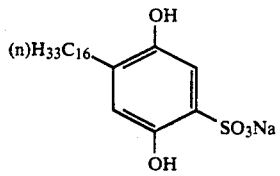
Cpd-A
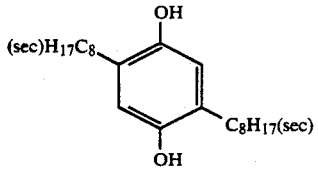
Cpd-B
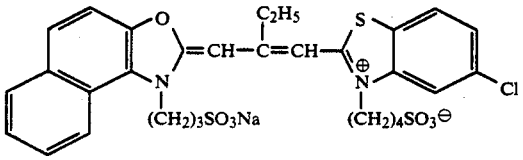
Sensitizing Dye I
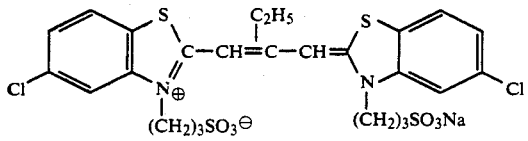
Sensitizing Dye II
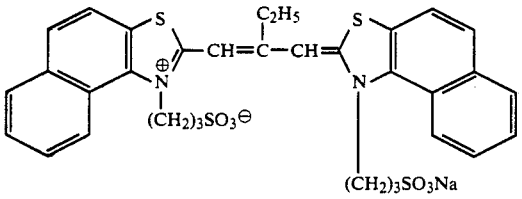
Sensitizing Dye III
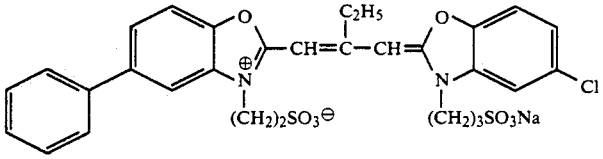
Sensitizing Dye IV
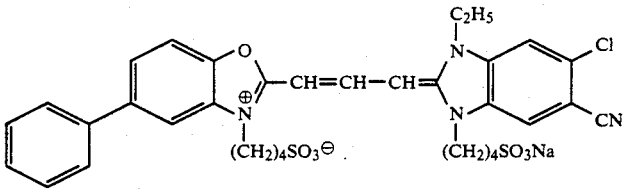
Sensitizing Dye V
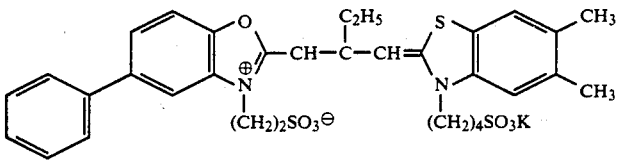
Sensitizing Dye VI
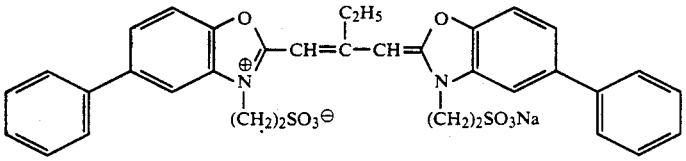
Sensitizing Dye VII -continued

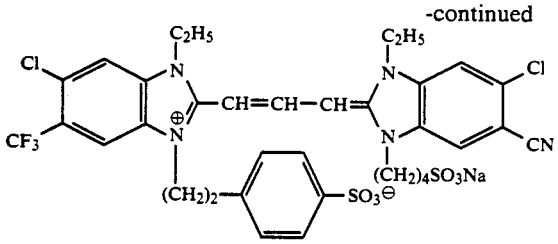

Sensitizing Dye VIII

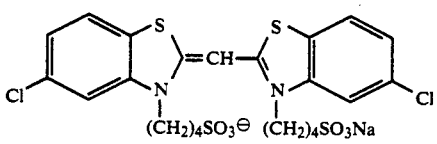

Sensitizing Dye IX

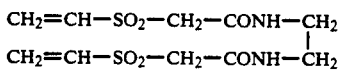

H-1

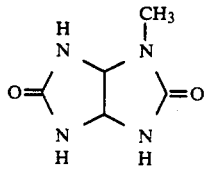

S'-1

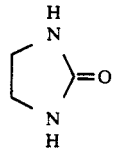

S'-2

The results obtained are shown in Table 5 below. In the Table, "relative sensitivity" is the reciprocal of an exposure providing a color density of fog+0.1, taking the sensitivity of Sample 20 as a standard (100)

TABLE 5

| Sample No. | Emulsion 5th Layer | Emulsion 12th Layer | Relative Sensitivity Cyan-Forming Layer | Relative Sensitivity Yellow-Forming Layer |
|---|---|---|---|---|
| 20 | E-1 | F-1 | 100 | 100 |
| 21 (Invention) | E-2 | F-2 | 126 | 132 |

As is apparent from Table 5, when a dye capable of being selectively adsorbed on a (111) plane was used, the emulsion of the present invention which selectively forms a latent image on a (100) plane exhibited higher sensitivity than the other emulsion.

EXAMPLE 7

A monodisperse emulsion of octahedral silver iodobromide grains (iodine content: 1 mol %) having a grain size of 2 μm and a monodisperse emulsion of cubic silver iodobromide grains (iodine content: 1 mol %) having a grain size of 0.5 μm were prepared. The two emulsions were mixed to prepare a mixed emulsion having (111) planes and (100) planes in equal proportions.

The mixed emulsion was spectrally sensitized with each of the sensitizing dyes shown in Table 6 at a pH of 6.5, a pAg of 8.4 and a temperature of 60° C. for 30 minutes, the dye being added in an amount of $10\times10^{-5}$ mol per mol of silver iodobromide which corresponded to an amount covering about 20% of the total surface area of silver iodobromide grains, taking the surface area of the grains as 70 $Å^2$ per molecule.

The thus-sensitized emulsion was filtered through a filter having a pore size of 0.8 μm, and the amount of the adsorbed dye in the filtrate (emulsion of cubic grains) was determined. The ratio of (a) the amount of the dye adsorbed to the cubic grains or the octahedral grains to (b) the amount of the dye added is shown in Table 6.

TABLE 6

| Dye | Ratio of Dye Adsorbed Based on Added Dye: On Cubic Grains (%) | On Octahedral Grains (%) |
|---|---|---|
| E-14 | ca. 100 | ca. 0 |
| E-1 | 98 | 2 |
| E-2 | ca. 100 | ca. 0 |
| E-3{ | 75 | 25 |
| E-7 | ca. 100 | ca. 0 |
| E-11 | ca. 100 | ca. 0 |
| E-13 | 96 | 4 |
| E-16 | ca. 100 | ca. 0 |
| E-20 | 62 | 38 |
| E-21 | ca. 100 | ca. 0 |
| E-22 | ca. 100 | ca. 0 |
| E-25 | 94 | 6 |
| E-27 | 98 | 2 |
| D-2 | 5 | 95 |
| E-5 | 2 | 98 |
| D-6 | ca. 0 | ca. 100 |
| D-8 | ca. 0 | ca. 100 |
| D-10 | 5 | 95 |
| D-20 | ca. 0 | ca. 100 |
| D-23 | 5 | 95 |

Note: *5 Minutes before the addition of E-3, 216 mg/mol-Ag of potassium iodide was added to the emulsion.

From the results of Table 6, it can be seen that the dyes designated "E" were not substantially or, if any, slightly adsorbed onto the octahedral grains, i.e., they preferentially were adsorbed onto (100) planes, while the dyes designated "D" started to be adsorbed onto (111) planes, just the opposite to the "E" dyes.

Thus, whether a dye is selectively adsorbed on a (100) plane or a (111) plane of silver halide grains can be quantitatively judged.

EXAMPLE 8

The tetradecahedral silver bromide emulsion as prepared in Example 1 was chemically sensitized with a sulfur sensitizer as shown in Table 7 at 60° C. for 60 minutes. Then, E-2 was added thereto in an amount of $3\times10^{-4}$ mol per mol of silver bromide. A stabilizer (4-hydroxy-6-methyl-1,3,3a,7-tetraazaindene; $4\times10^{-3}$ mol/mol AgBr) and the same coating aid, thickener and hardening agent as used in Example 1 were further added to the emulsion. The resulting coating composition was coated on a cellulose acetate film support together with a gelatin protective layer. The resulting light-sensitive materials were designated as Samples 22 to 26.

Each of samples 22 to 26 was exposed to light through an optical wedge and a yellow filter and developed with a developer "Hilendol" at 20° C. for 4 minutes. The results obtained are shown in Table 7, in which "relative sensitivity" is the reciprocal of an exposure providing a density of fog+0.2, taking the sensitivity of Sample 22 as a standard (100).

The site of fine developed silver specks, as determined by the arrested development method described in Example 1, is also shown in Table 7.

TABLE 7

| Sample No. | Chemical Sensitizer | Amount of Chemical Sensitizer (mol/mol-Ag) | Relative Sensitivity | Site of Latent Image Formation |
|---|---|---|---|---|
| 22 | Sodium Thiosulfate (comparison) | $1.6\times10^{-5}$ | 100 | (111) plane |
| 23 | S-2 | $8\times10^{-6}$ | 250 | (100) plane |
| 24 | S-3 | $8\times10^{-6}$ | 280 | (100) plane |
| 25 | S-5 | $8\times10^{-6}$ | 205 | (100) plane to the corner edges |
| 26 | S-10 | $1.6\times10^{-5}$ | 190 | (100) plane to the corner edges |

It can be seen from Table 7 that formation of a latent image on planes other than (111) planes, i.e., on (100) planes resulted in markedly increased sensitivity.

EXAMPLE 9

Emulsions A, B, C and D as prepared in Example 4 were used.

Emulsion A was chemically sensitized with sodium thiosulfate, chloroauric acid, and potassium thiocyanate at 60° C. for 60 minutes, and then E-1 and D-2 were added thereto in an amount of $2.5\times10^{-4}$ mol and $2.0\times10^{-4}$ mol, respectively, each per mol of silver.

Emulsion B was chemically sensitized with S-2, chloroauric acid, and potassium thiocyanate, and the same amounts of the same dyes as used above were then added thereto.

D-2 was first added to Emulsion C, and the emulsion was chemically sensitized with sodium thiosulfate, chloroauric acid, and potassium thiocyanate at 60° C. for 60 minutes. Then, E-1 was added thereto.

D-2 was first added to Emulsion D, and the emulsion was chemically sensitized with S-2, chloroauric acid, and potassium thiocyanate at 60° C. for 60 minutes. Then, E-1 was added thereto.

To each of the emulsions were added couplers (C-1, C-11, C-13 and C-15), dispersing oils (Oil-1 and Oil-2), an antifoggant (1-(m-sulfophenyl)-5-mercaptotetrazole monosodium salt), and a stabilizer (4-hydroxy-6-methyl-1,3,3a,7-tetraazaindene). The same coating aid, thickener and hardening agent as used in Example 1 were further added thereto. The resulting coating composition was coated on a cellulose acetate film support together with a gelatin protective layer.

The resulting sample was exposed to light through an optical wedge and a yellow filter and subjected to color development processing according to the same procedure as in Example 4. The results obtained are shown in Table 8, in which the sensitivity is relatively expressed taking that of Emulsion A as a standard (100). Further, the site of a latent image formation was examined in the same manner as in Example 7 and the results are also shown in Table 8.

The compounds used in the sample preparation are the same as those used in Example 6.

TABLE 8

| Emulsion | Relative Sensitivity | Site of Latent Image Formation |
|---|---|---|
| A | 100 | Predominantly on (111) plane, a few on (100) plane |
| B | 118 | Predominantly on (100) plane, a few on (111) plane |
| C | 126 | Predominantly on (100) plane |
| D | 132 | Predominantly on (100) plane |

As is apparent from Table 8, when E-1 which is selectively adsorbed on (100) planes was used as a sensitizing dye, emulsions which form sites where a latent image is formed on planes other than a (111) plane, i.e., (100) planes, exhibited higher sensitivity.

It is also demonstrated that chemical sensitization could be selectively effected on (100) planes while (111) planes were covered with D-2 which is selectively adsorbed on the (111) planes, though making no contribution to spectral sensitivity to light transmitted by a yellow filter.

EXAMPLE 10

A tetradecahedral silver bromide emulsion was prepared in the same manner as in Example 1, except for maintaining the pAg of the grain formation system at 7.8. The surface of the silver bromide grains was found to be composed of 67% of a (100) plane and 33% of a (111) plane.

After adjustment to a pH of 6.3 and a pAg of 8.5, the emulsion was chemically sensitized with a sulfur sensitizer as shown in Table 9 at 60° C. for 60 minutes. Then, a sensitizing dye, D-8, was added to the emulsion in an amount of $3\times10^{-4}$ mol per mol of silver bromide. A stabilizer (4-hydroxy-6-methyl-1,3,3a,7-tetraazaindene; $4\times10^{-3}$ mol/mol AgBr) and the same coating aid, thickener and hardening agent as used in Example 1 were further added thereto. The resulting coating composition was coated on a cellulose acetate film support together with a gelatin protective layer. The resulting light-sensitivity materials were designated as Samples 27 to 31.

Each of Samples 27 to 31 was exposed to light through an optical wedge and a yellow filter and developed with "Hilendol" at 20° C. for 4 minutes. The results obtained are shown in Table 9, in which "relative sensitivity" is the reciprocal of an exposure providing a density of fog +0.2, taking the sensitivity of Sample 27 as a standard (100). Table 9 also shows the site of fine developed silver specks as determined in the same manner as in Example 1.

TABLE 9

| Sample No. | Chemical Sensitizer | Amount of Chemical Sensitizer (mol/mol-Ag) | Relative Sensitivity | Site of Latent Image Formation |
|---|---|---|---|---|
| 27 | Sodium Thiosulfate (comparison) | $2.4 \times 10^{-5}$ | 100 | (111) plane a few on (100) plane |
| 28 | S-2 | $8 \times 10^{-6}$ | 316 | (100) plane |
| 29 | S-3 | $8 \times 10^{-6}$ | 352 | (100) plane |
| 30 | S-5 | $1.2 \times 10^{-5}$ | 178 | (100) plane to the edges |
| 31 | S-10 | $1.6 \times 10^{-5}$ | 162 | (100) plane to the edges |

EXAMPLE 11

A monodisperse tetradecahedral silver iodobromide emulsion (iodine content: 2 mol %, grain size: about 0.6 μm) having 65% of a (100) plane and 35% of a (111) plane was prepared in the same manner as in Example 10. After washing with water and desalting, the emulsion was adjusted to a pH of 6.5 and a pAg of 8.5. The emulsion was divided into four portions, designated as Emulsions G, H, I and J.

Emulsion G was chemically sensitized with sodium thiosulfate, chloroauric acid, and potassium thiocyanate at 60° C. for 60 minutes, and then D-8, E-13 and E-20 were added thereto in an amount of $2.5 \times 10^{-4}$ mol, $1 \times 10^{-5}$ mol, and $1.0 \times 10^{-4}$ mol, respectively, each per mol of silver.

Emulsion H was chemically sensitized with S-2, chloroauric acid, and potassium thiocyanate, and then the same amounts of the same dyes as added to Emulsion G were added thereto.

D-8 was first added to Emulsion I, and the emulsion was sensitized with sodium thiosulfate, chloroauric acid, and potassium thiocyanate at 60° C. for 60 minutes. E-13 and E-20 were then added to the emulsion.

After D-8 was added to Emulsion J, Emulsion J was chemically sensitized with S-2, chloroauric acid, and potassium thiocyanate at 60° C. for 60 minutes. E-13 and E-20 were then added thereto.

To each of the emulsions were added couplers (C-6 and C-7), dispersing oils (Oil-1 and Oil-2), an monosodium salt; $2 \times 10^{-4}$ mol/mol silver halide), a stabilizer (4-hydroxy-6-methyl-1,3,3a,7-tetraazaindene; $3 \times 10^{-3}$ mol/mol silver halide), and the same coating aid, thickener and hardening agent as used in Example 1. The resulting coating composition was coated on a cellulose acetate film support together with a gelatin protective layer to prepare a light-sensitive material.

The couplers and dispersing oils used in this example were the same as used in Example 6.

Each of the samples was exposed to light through an optical wedge and a yellow filter and development-processed in the same manner as in Example 4. The results obtained are shown in Table 10. The site for latent image formation was determined by arrested development in the same manner as in Example 1, and the results are also shown in Table 10.

TABLE 10

| Emulsion | Relative Sensitivity of Cyan Dye Image | Site for Latent Image Formation |
|---|---|---|
| G | 100 | Predominantly on (111) plane, a few on (100) plane. |
| H | 115 | Predominantly on (100) plane, slightly on (111) plane |
| I | 120 | (100) plane |
| J | 123 | (100) plane |

It can be seen from Table 10 that the emulsions which formed a latent image selectively on (100) planes exhibited higher sensitivity than those forming a latent image selectively on (111) planes. In other words, higher spectral sensitivity was obtained by using a sulfur sensitizer capable of selectively sensitizing a (100) plane than using sodium thiosulfate which selectively sensitized a (111) plane, or by adding a dye capable of being selectively adsorbed on a (111) plane and then chemically sensitizing a (100) plane selectively.

EXAMPLE 12

Emulsions G and J as prepared in Example 11 were treated in the same manner as in Example 11, except for replacing D-8 with D-17, D-18 or D-20, and tested in the same manner as in Example 11.

As a result, Emulsion J proved more highly sensitive than Emulsion G in any case.

EXAMPLE 13

Silver bromide was grown as an outer shell on seed crystals of silver iodobromide having an iodine content of 18 mol % to prepare a monodisperse emulsion containing tetradecahedral core/shell grains having a of 0.8 μm and composed of 72% of a (100) plane and 28% of a (111) plane. The resulting emulsion was designated as Emulsion K. After adjusting the pH to 6.3 and the pAg to 8.5, Emulsion K was divided into four portions, designated as K-1, K-2, K-3 and K-4.

Emulsion K-1 was chemically sensitized with sodium thiosulfate, chloroauric acid, and potassium thiocyanate, and then E-1, E-11 and D-2 were added thereto.

Emulsion K-2 was chemically sensitized with S-3, chloroauric acid, and potassium thiocyanate, and then E-1, E-11 and D-2 were added thereto.

D-2 was first added to Emulsion K-3, and the emulsion was chemically sensitized with sodium thiosulfate, chloroauric acid and potassium thiocyanate. Thereafter, E-1 and E-11 were added to the emulsion.

D-2 was first added to Emulsion K-4, and the emulsion was chemically sensitized with S-3, chloroauric acid and potassium thiocyanate. Thereafter, E-1 and E-11 were added thereto.

Each of the thus-sensitized emulsions was coated on a support in a single layer and subjected to arrested development. As a result, it was confirmed that Emulsions K-2, K-3 and K-4, and particularly K-3 and K-4, formed developed silver specks on (100) planes, while Emulsion K-1 formed developed silver specks on the entire surface of the grains, and particularly on corners of the grains, i.e., on (111) planes.

Then, a multilayer color light-sensitive material was prepared having the same layer structure as described in Example 6, except for replacing the emulsion of the ninth layer with Emulsion K-1, K-2, K-3 or K-4. The resulting samples were designated as Samples 32, 33, and 35, respectively.

Each of Samples 32 to 35 was exposed to light at 25 CMS using a tungsten lamp (color temperature adjusted to 4,800° K. through a filter) and then subjected to the same development processing at 38° C. as described in Example 4. The results obtained are shown in Table 11, in which the relative sensitivity is the reciprocal of an exposure providing a color density of fog +0.1, taking the sensitivity of Sample 32 as a standard (100).

TABLE 11

| Sample No. | Relative Sensitivity of Magenta-Forming Layer |
|---|---|
| 32 | 100 |
| 33 | 110 |
| 34 | 115 |
| 35 | 115 |

As is apparent from Table 11, emulsions forming a latent image on a (100) plane exhibited higher sensitivity than other emulsions.

While the invention has been described in detail and with reference to specific embodiments thereof, it will be apparent to one skilled in the art that various changes and modifications can be made therein without departing from the spirit and scope thereof.

What is claimed is:

1. A process for producing a silver halide photographic emulsion comprising substantially normal silver halide grains comprising a (111) plane and a (100) plane, wherein said (111) plane occupies at least 40% of the surface of said grains, said emulsion having chemically sensitized nuclei formed preferentially on the (100) plane, comprising (a) adding a spectral sensitizing dye capable of selectively adsorbing to a greater extend on the (111) plane than on the (100) plane, and (b) subjecting said emulsion to non-selective chemical sensitization with a sulfur sensitizer such that chemically sensitized nuclei are preferentially formed on the (100) plane of the grains, wherein said adding step (a) is carried out before said subjecting step (b).

2. A process for producing a silver halide photographic emulsion as claimed in claim 1, wherein the process comprises adding a spectral sensitizing dye capable of selectively adsorbing more on the (100) plane than on the (111) during or after chemical sensitization.

3. A process for producing a silver halide photographic emulsion as claimed in claim 2, wherein the spectral sensitizing dye capable of selectively adsorbing on the (100) plane is a sensitizing dye wherein said sensitizing dye is selected from the group consisting of benzoxacyanine, benzimidacyanine, benzoxalimidacyanine, benzoxathiacyanine, benzimidathiacyanine, benzoxaselenacyanine, benzimidaselenacyanine, benzothiacyanine having a substituent other than a halogen atom at the 5-position, benzoselenacyanine having a substituent other than a halogen atom at the 5-position, and benzothiaselenacyanine having a substituent other than a halogen atom at the 5-position.

4. A process for producing a silver halide photographic emulsion as claimed in claim 2, wherein the spectral sensitizing dye capable of selectively adsorbing on the (100) plane is present in an amount of $1\times10^{-7}$ to $2\times10^{-3}$ mole per mol of silver halide.

5. A process for producing a silver halide photographic emulsion as claimed in claim 1, wherein said (111) plane occupies at least about 60% of the surface of said substantially normal grains.

6. A process for producing a silver halide photographic emulsion as claimed in claim 5, wherein said (111) plan occupies at least about 80% of the surface of said substantially normal grains, and said (100) plane occupies from about 5 to about 20% of the surface of said substantially normal grains.

7. A process for producing a silver halide photographic emulsion as claimed in claim 1, wherein the spectral sensitizing dye capable of selectively adsorbing on the (111) plane is a cyanine, a merocyanine or a complex merocyanine.

8. A process for producing a silver halide photographic emulsion as claimed in claim 7, wherein the cyanine dye is a thiocyanine, a selenacyanine, a quinocyanine, a thiaquinocyanine or a selenaquinocyanine.

9. A process for producing a silver halide photographic emulsion as claimed in claim 8, wherein said cyanine dye is a benzothiacyanine, a benzoselenacyanine or a benzothiaselenacyanine, each substituted with a halogen at the 5-position; a thiaquinocyanine comprising a thiazole ring substituted with a halogen at the 5-position, a selenaquinocyanine comprising a selenazole ring substituted with a halogen at the 5-position; or a quinocyanine.

10. A process for producing a silver halide photographic emulsion as claimed in claim 1, wherein said sensitizing dye is present in at least an amount sufficient to saturate said (111) plane and at most an amount sufficient to saturate said (111) and (100) planes.

11. A process for producing a silver halide photographic emulsion as claimed in claim 1, wherein the spectral sensitizing dye capable of selectively adsorbing on the (111) plane is present in an amount of $1\times10^{-7}$ to $2\times10^{-3}$ mol per mol of silver halide.

12. A process for producing a silver halide photographic emulsion as claimed in claim 1, wherein the sulfur sensitizer is selected from the group consisting of thiosulfate, thiourea, rhodanine, a compound represented by formula (S-11):

S-11

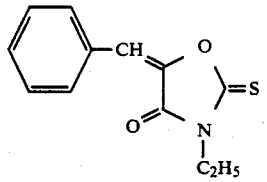

and a compound represented by formula (S-12):

S-12

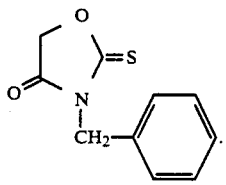

13. A process for producing a silver halide photographic emulsion as claimed in claim 12, wherein the sulfur sensitizer is present in an amount of $1\times10^{-8}$ to $1\times10^{-3}$ mol per mol of silver halide.

* * * * *